US006334105B1

(12) United States Patent
Ehara

(10) Patent No.: US 6,334,105 B1
(45) Date of Patent: Dec. 25, 2001

(54) MULTIMODE SPEECH ENCODER AND DECODER APPARATUSES

(75) Inventor: Hiroyuki Ehara, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/529,660

(22) PCT Filed: Aug. 20, 1999

(86) PCT No.: PCT/JP99/04468

§ 371 Date: Apr. 18, 2000

§ 102(e) Date: Apr. 18, 2000

(87) PCT Pub. No.: WO00/11646

PCT Pub. Date: Mar. 2, 2000

(30) Foreign Application Priority Data

Aug. 21, 1998 (JP) ..... 10-236147
Sep. 21, 1998 (JP) ..... 10-266883

(51) Int. Cl.[7] ..... G10L 19/06; G10L 13/08; G10L 21/04; G10L 19/12; G10L 19/02

(52) U.S. Cl. ..... 704/258; 704/201; 704/500; 704/203; 704/221; 704/229; 704/230

(58) Field of Search ..... 704/201, 203, 704/204, 258, 269, 500, 205, 229, 221, 230

(56) References Cited

U.S. PATENT DOCUMENTS 5,012,519 * 4/1991 Adlersberg ..... 704/226
5,224,167 * 6/1993 Taniguchi et al. ..... 704/219
5,414,796 * 5/1995 Jacobs et al. ..... 704/224
5,490,130 * 2/1996 Akagiri ..... 704/201
5,596,676 * 1/1997 Swaminathan ..... 704/268
5,706,394 * 1/1998 Wynn ..... 704/226
5,729,655 * 3/1998 Kolesnik et al. ..... 704/262
5,978,762 * 11/1999 Smyth et al. ..... 704/229
6,055,619 * 4/2000 North et al. ..... 704/270

FOREIGN PATENT DOCUMENTS 2290201 12/1995 (GB) .
6118993 4/1994 (JP) .
10143195 5/1998 (JP) .

OTHER PUBLICATIONS

PCT International Search Report dated Nov. 30, 1999.
T. Morii et al., "Multi–Mode CELP Codec using Short–Term Characteristics of Speech," Technical Report of IEICE, SP 95–80 (1995–11), pp. 55–62 (with abstract in English).
M. Oshikiri et al., "A Speech/Silence Segmentation Method using Spectral Variation and the Application to a Variable Rate Speech Codec," Proceedings of the 1997 Spring Meeting of the Acoustical Society of Japan (1998), pp. 281–282 (with comments in English by the Applicant).
O. Mizuno et al., "Speech Discrimination using Dynamic and Static Spectral Features," pp. 107–108 (with comments in English by the Applicant).

(List continued on next page.)

*Primary Examiner*—Richemond Dorvil
*Assistant Examiner*—Daniel A. Nolan
(74) *Attorney, Agent, or Firm*—Stevens, Davis, Miller & Mosher, LLP

(57) ABSTRACT

The present invention relates to a low bit rate speech coding apparatus which performs coding on a speech signal for transmission, for example, in a mobile communication system. Excitation information is coded in multimode using both static and dynamic characteristics of quantized vocal tract parameters. Decoding includes postprocessing in multimode, thereby improving the quality of both unvoiced speech regions and stationary noise regions of the transmitted speech signal.

28 Claims, 12 Drawing Sheets

OTHER PUBLICATIONS

H. Tasaki et al., "Post Noise Smoother to Improve Low Bit Rate Speech Coding Performance under Background Noise Conditions," pp. 237–238 ( with comments in English by the Applicant).

M. Oshikiri et al., "A 2.4 kbps Variable Bit Rate ADP–CELP Speech Coder," p. 1492 (with comments in English by the Applicant.).

T. Yamaura et al., "Improving Excitation Coding in Pitch Position Synchronized CELP," pp. 239–240 (with comments in English by the Applicant).

Abstract and partial claims from Japanese publication of U.S. Patent No. 5,596,678, Jan. 21, 1997, Karl T. Wigren et al. (three pages in English).

M. R. Schroeder et al., "Code–excited Linear Prediction (CELP): High–quality Speech at Very Low Bit Rates," Proc. ICASSP–85, 24.1.1., pp. 937–940, 1985.

* cited by examiner

MULTIMODE SPEECH ENCODER AND DECODER APPARATUSES

TECHNICAL FIELD

The present invention relates to a low-bit-rate speech coding apparatus which performs coding on a speech signal to transmit, for example, in a mobile communication system, and more particularly, to a CELP (Code Excited Linear Prediction) type speech coding apparatus which separates the speech signal to vocal tract information and excitation information to represent.

BACKGROUND ART

Used in the fields of digital mobile communications and speech storage are speech coding apparatuses which compress speech information to encode with high efficiency for utilization of radio signals and recording media. Among them, the system based on a CELP (Code Excited Linear Prediction) system is carried into practice widely for the apparatuses operating at medium to low bit rates. The technology of the CELP is described in "Code-excited Linear Prediction (CELP):High-quality Speech at Very Low Bit Rates" by M. R. Schroeder and B. S. Atal, Proc. ICASSP-85, 24.1.1, pp.937–940, 1985.

In the CELP type speech coding system, speech signals are divided into predetermined frame lengths (about 5 ms to 50 ms), linear prediction of the speech signals is performed for each frame, the prediction residual (excitation vector signal) obtained by the linear prediction for each frame is encoded using an adaptive code vector and random code vector comprised of known waveforms. The adaptive code vector and random code vector are selected for use respectively from an adaptive codebook storing previously generated excitation vectors and a random codebook storing the predetermined number of pre-prepared vectors with predetermined shapes. Used as the random code vectors stored in the random codebook are, for example, random noise sequence vectors and vectors generated by arranging a few pulses at different positions.

The CELP coding apparatus performs the LPC synthesis and quantization, pitch search, random codebook search, and gain codebook search using input digital signals, and transmits the quantized LPC (L), pitch period (P), a random codebook index (S) and a gain codebook index (G) to a decoder.

However, the above-mentioned conventional speech coding apparatus needs to cope with voiced speeches, unvoiced speeches and background noises using a single type of random codebook, and therefore it is difficult to encode all the input signals with high quality.

DISCLOSURE OF INVENTION

An object of the present invention is to provide a multimode speech coding apparatus and speech decoding apparatus capable of providing excitation coding with multimode without newly transmitting mode information, in particular, performing judgment of speech region/non-speech region in addition to judgment of voiced region/unvoiced region, and further increasing the improvement of coding/decoding performance performed with the multimode.

In the present invention, the mode determination is performed using static/dynamic characteristics of a quantized parameter representing spectral characteristics, modes of various codebooks for use in coding excitation vectors are switched based on the mode determination indicating the speech region/non-speech region or voiced region/unvoiced region. Further, in the present invention, the modes of various codebooks for use in decoding are switched using the mode information used in the coding in decoding.

BEST MODE FOR CARRYING OUT THE INVENTION

Speech coding apparatuses and others in embodiments of the present invention are explained below using FIG. 1 to FIG. 9.

(First Embodiment)

Figure 1:
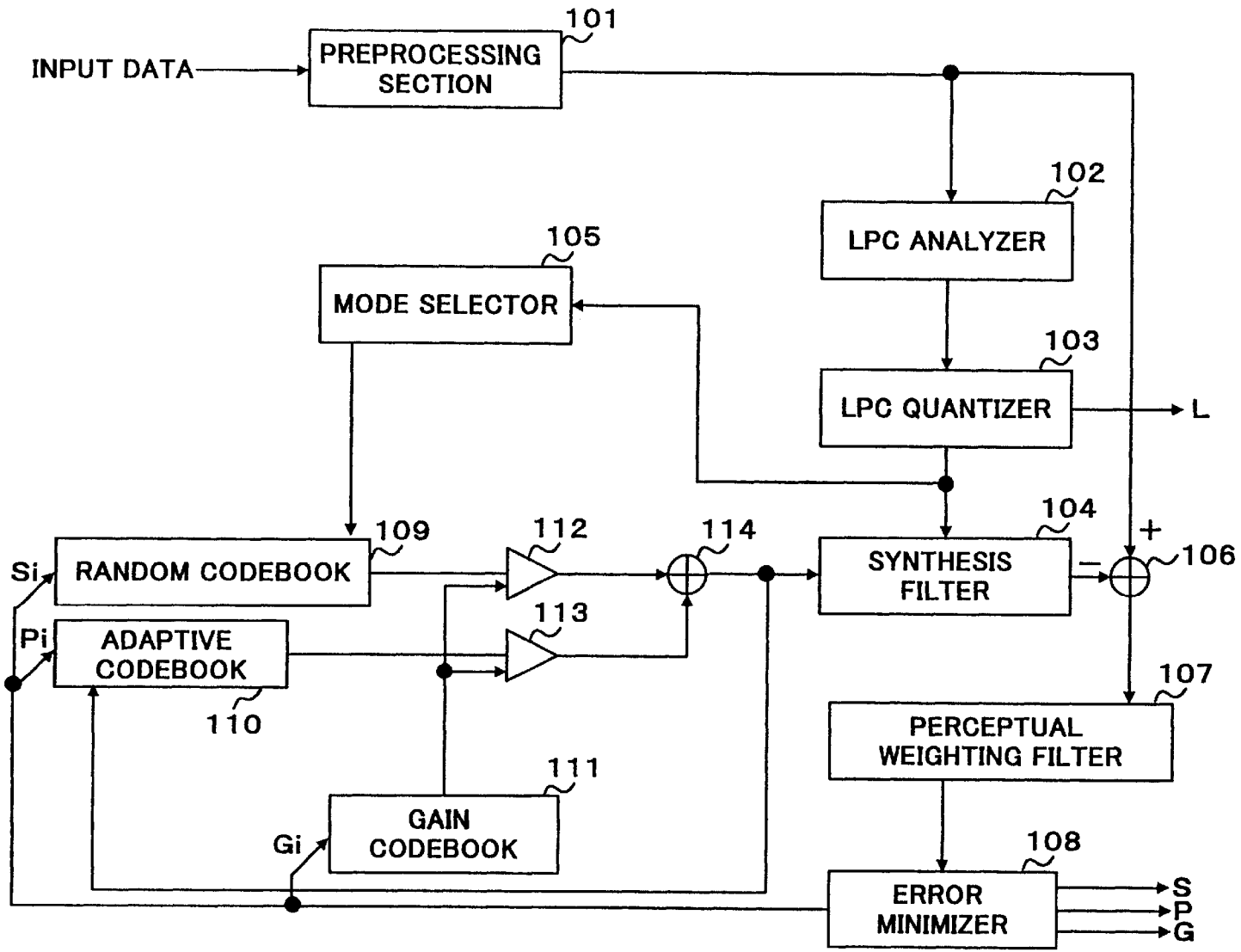
FIG. 1 is a block diagram illustrating a speech coding apparatus in a first embodiment of the present invention.

FIG. 1 is a block diagram illustrating a configuration of a speech coding apparatus according to the first embodiment of the present invention.

Input data, comprised of, for example, digital speech signals, is input to preprocessing section 101. Preprocessing section 101 performs processing such as cutting of a direct current component and bandwidth limitation of the input data using a high-pass filter and band-pass filter to output to LPC analyzer 102 and adder 106. In addition, although it is possible to perform successive coding processing without performing any processing in preprocessing section 101, the coding performance is improved by performing the above-mentioned processing.

LPC analyzer 102 performs linear prediction analysis, and calculates linear predictive coefficients (LPC) to output to LPC quantizer 103.

LPC quantizer 103 quantizes the input LPC, outputs the quantized LPC to synthesis filter 104 and mode selector 105, and further outputs a code L that represents the quantized LPC to decoder. In addition, the quantization of LPC is performed usually after LPC is converted to LSP (Line Spectrum Pair) which has better interpolation characteristics.

As synthesis filter 104, a LPC synthesis filter is constructed using the quantized LPC input from LPC quantizer 103. With the constructed synthesis filter, filtering processing is performed on an excitation vector signal input from adder 114, and the resultant signal is output to adder 106.

Mode selector 105 determines a mode of random codebook using the quantized LPC input from LPC quantizer 103.

At this time, mode selector 105 stores previously input information on quantized LPC, and performs the selection of mode using both characteristics of an evolution of quantized LPC between frames and of the quantized LPC in a current frame. There are at least two types of the modes, of which examples are a mode corresponding to a voiced speech segment, and a mode corresponding to an unvoiced speech segment and stationary noise segment. Further, as information for use in selecting a mode, it is not necessary to use the quantized LPC themselves, and it is more effective to use converted parameters such as the quantized LSP, reflective coefficients and linear prediction residual power.

Adder 106 calculates an error between the preprocessed input data input from preprocessing section 101 and the synthesized signal to output to perceptual weighting filter 107.

Perceptual weighting filter 107 performs perceptual weighting on the error calculated in adder 106 to output to error minimizer 108.

Error minimizer 108 adjusts a random codebook index Si, adaptive codebook index (pitch period) Pi, and gain codebook index Gi respectively output to random codebook 109, adaptive codebook 110, and gain codebook 111, determines a random code vector, adaptive code vector, and random codebook gain and adaptive codebook gain respectively to be generated in random codebook 109, adaptive codebook 110, and gain codebook 111 so as to minimize the perceptual weighted error input from perceptual weighting filter 107, and outputs a code S representing the random code vector, a code P representing the adaptive code vector, and a code G representing gain information to decoder.

Random codebook 109 stores the predetermined number of random code vectors with different shapes, and outputs the random code vector designated by the index Si of random code vector input from error minimizer 108. Random codebook 109 has at least two types of modes. For example, random codebook 109 is configured to generate a pulse-like random code vector in the mode corresponding to a voiced speech segment, and further generate a noise-like random code vector in the mode corresponding to an unvoiced speech segment and stationary noise segment. The random code vector output from random codebook 109 is generated with a single mode selected in mode selector 105 from among at least two types of the modes described above, and multiplied by the random codebook gain Gs in multiplier 112 to be output to adder 114

Adaptive codebook 110 performs buffering while updating the previously generated excitation vector signal sequentially, and generates the adaptive code vector using the adaptive codebook index (pitch period (pitch lag)) input from error minimizer 108. The adaptive code vector generated in adaptive codebook 110 is multiplied by the adaptive codebook gain Ga in multiplier 113, and then output to adder 114.

Gain codebook 111 stores the predetermined number of sets of the adaptive codebook gain Ga and random codebook gain Gs (gain vector), and outputs the adaptive codebook gain component Ga and random codebook gain component Gs of the gain vector designated by the gain codebook index Gi input from error minimizer 108 respectively to multipliers 113 and 112. In addition, if the gain codebook is constructed with a plurality of stages, it is possible to reduce a memory amount required for the gain codebook and a computation amount required for gain codebook search. Further, if the number of bits assigned for the gain codebook is sufficient, it is possible to scalar-quantize the adaptive codebook gain and random codebook gain independently of each other.

Adder 114 adds the random code vector and the adaptive code vector respectively input from multipliers 112 and 113 to generate the excitation vector signal, and outputs the generated excitation vector signal to synthesis filter 104 and adaptive codebook 110.

In addition, in this embodiment, although only random codebook 109 is provided with the multimode, it is possible to provide adaptive codebook 110 and gain codebook 111 with the multimode, and thereby to improve the quality.

Figure 3:
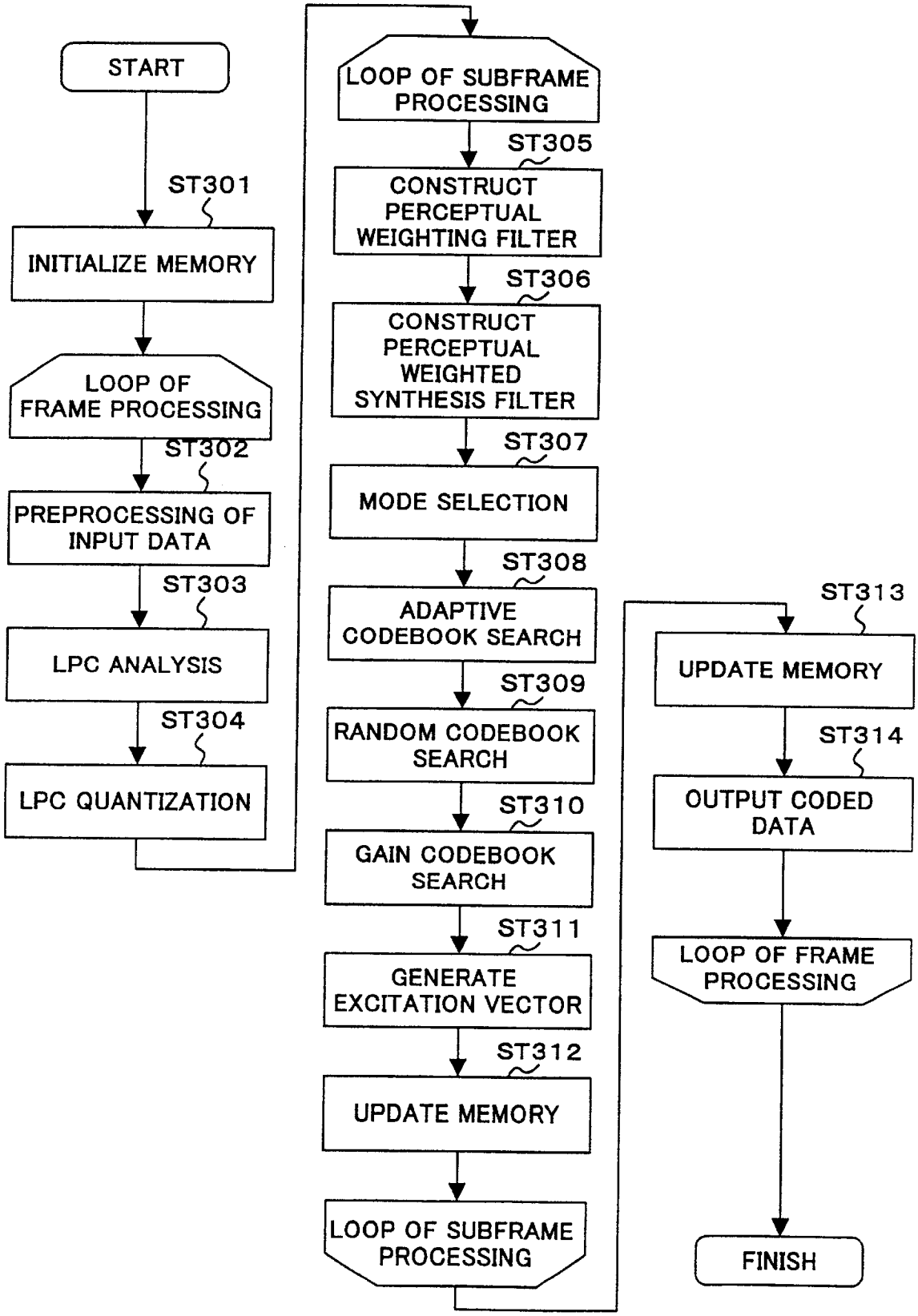
FIG. 3 is a flowchart for speech coding processing in the first embodiment of the present invention.

The flow of processing of speech coding method in the above-mentioned embodiment is next described with reference to FIG. 3. This explanation describes the case that in the speech coding processing, the processing is performed for each unit processing with a predetermined time length (frame with the time length of a few tens msec), and further the processing is performed for each shorter unit processing (subframe) obtained by dividing a frame into the Integer number of lengths.

In step (hereinafter abbreviated as ST) 301, all the memories such as the contents of the adaptive codebook, synthesis filter memory and input buffer are cleared.

Next, in ST302, input data such as a digital speech signal corresponding to a frame is input, and filters such as a high-pass filter and band-pass filter are applied to the input data to perform offset cancellation and bandwidth limitation of the input data. The preprocessed input data is buffered in an input buffer to be used for the following coding processing.

Next, in ST303, the LPC (linear predictive coefficients) analysis is performed and LP (linear predictive) coefficients are calculated.

Next, in ST304, the quantization of the LP coefficients calculated in ST303 is performed. While various quantization methods of LPC are proposed, the quantization can be performed effectively by converting LPC into LSP parameters with good interpolation characteristics to apply the predictive quantization utilizing the multistage vector quantization and inter-frame correlation. Further, for example in the case where a frame is divided into two subframes, it is general to quantize the LPC of the second subframe, and determine the LPC of the first subframe by the interpolation processing using the quantized LPC of the second subframe of the last frame and the quantized LPC of the second subframe of the present frame.

Next, in ST305, the perceptual weighting filter that performs the perceptual weighting on the preprocessed input data is constructed.

Next, in ST306, a perceptual weighted synthesis filter that generates a synthesized signal of a perceptual weighting domain from the excitation vector signal is constructed. This filter is comprised of the synthesis filter and perceptual weighting filter in a subordination connection. The synthesis filter is constructed with the quantized LPC quantized in ST304, and the perceptual weighting filter is constructed with the LPC calculated in ST303.

Next, in ST307, the selection of mode is performed. The selection of mode is performed using static and dynamic characteristics of the quantized LPC quantized in ST304. Examples of specifically used characteristics are an evolution of quantized LSP, reflective coefficients calculated from the quantized LPC, and prediction residual power. Random codebook search is performed according to the mode selected in this step. There are at least two types of the modes to be selected in this step. An example considered is a two-mode structure of a voiced speech mode, and an unvoiced speech and stationary noise mode.

Next, in ST 308, adaptive codebook search is performed. The adaptive codebook search is to search an adaptive code vector such that a perceptual weighted synthesized waveform is generated that is the closest to a waveform obtained by performing the perceptual weighting on the preprocessed input data. A position from which the adaptive code vector is fetched is determined so as to minimize an error between a signal obtained by filtering the preprocessed input data with the perceptual weighting filter constructed in ST305, and a signal obtained by filtering the adaptive code vector fetched from the adaptive codebook as an excitation vector signal with the perceptual weighted synthesis filter constructed in ST306.

Next, in ST309, the random codebook search is performed. The random codebook search is to select a random code vector to generate an excitation vector signal such that a perceptual weighted synthesized waveform is generated that is the closest to a waveform obtained by performing the perceptual weighting on the preprocessed input data. The search is performed in consideration of that the excitation vector signal is generated by adding the adaptive code vector and random code vector. Accordingly, the excitation vector signal is generated by adding the adaptive code vector determined in ST308 and the random code vector stored in the random codebook. The random code vector is selected from the random code book so as to minimize an error between a signal obtained by filtering the generated excitation vector signal with the perceptual weighted synthesis filter constructed in ST306, and the signal obtained by filtering the preprocessed input data with the perceptual weighting filter constructed in ST305. In addition, in the case where processing such as pitch period processing is performed on the random code vector, the search is performed also in consideration of such processing. Further this random codebook has at least two types of the modes. For example, the search is performed by using the random codebook storing pulse-like random code vectors in the mode corresponding to the voiced speech segment, and using the random codebook storing noise-like random code vectors in the mode corresponding to the unvoiced speech segment and stationary noise segment. The random codebook of which mode is used in the search is selected in ST307.

Next, in ST310, gain codebook search is performed. The gain codebook search is to select from the gain codebook a pair of the adaptive codebook gain and random codebook gain respectively to be multiplied the adaptive code vector determined in ST308 and the random code vector determined in ST309. The excitation vector signal is generated by adding the adaptive code vector multiplied by the adaptive codebook gain and the random code vector multiplied by the random codebook gain. The pair of the adaptive codebook gain and random codebook gain is selected from the gain codebook so as to minimize an error between a signal obtained by filtering the generated excitation vector signal with the perceptual weighted synthesis filter constructed in ST306, and the signal obtained by filtering the preprocessed input data with the perceptual weighting filter constructed in ST305.

Next, in ST311, the excitation vector signal is generated. The excitation vector signal is generated by adding a vector obtained by multiplying the adaptive code vector selected in ST308 by the adaptive codebook gain selected in ST310 and a vector obtained by multiplying the random code vector selected in ST309 by the random codebook gain selected in ST310.

Next, in ST312, the update of the memory used in a loop of the subframe processing is performed. Examples specifically performed are the update of the adaptive codebook, and the update of states of the perceptual weighting filter and perceptual weighted synthesis filter.

In ST305 to ST312, the processing is performed on a subframe-by-subframe basis.

Next, in ST313, the update of memory used in a loop of the frame processing. Examples specifically performed are the update of states of the filter used in the preprocessing section, the update of quantized LPC buffer (in the case where the inter-frame predictive quantization of LPC is performed), and the update of input data buffer.

Next, in ST314, coded data is output. The coded data is output to a transmission path while being subjected to bit stream processing and multiplexing processing corresponding to the form of the transmission.

In ST302 to 304 and ST313 to 314, the processing is performed on a frame-by-frame basis. Further the processing on a frame-by-frame basis and subframe-by-subframe is iterated until the input data is consumed.

(Second Embodiment)

Figure 2:
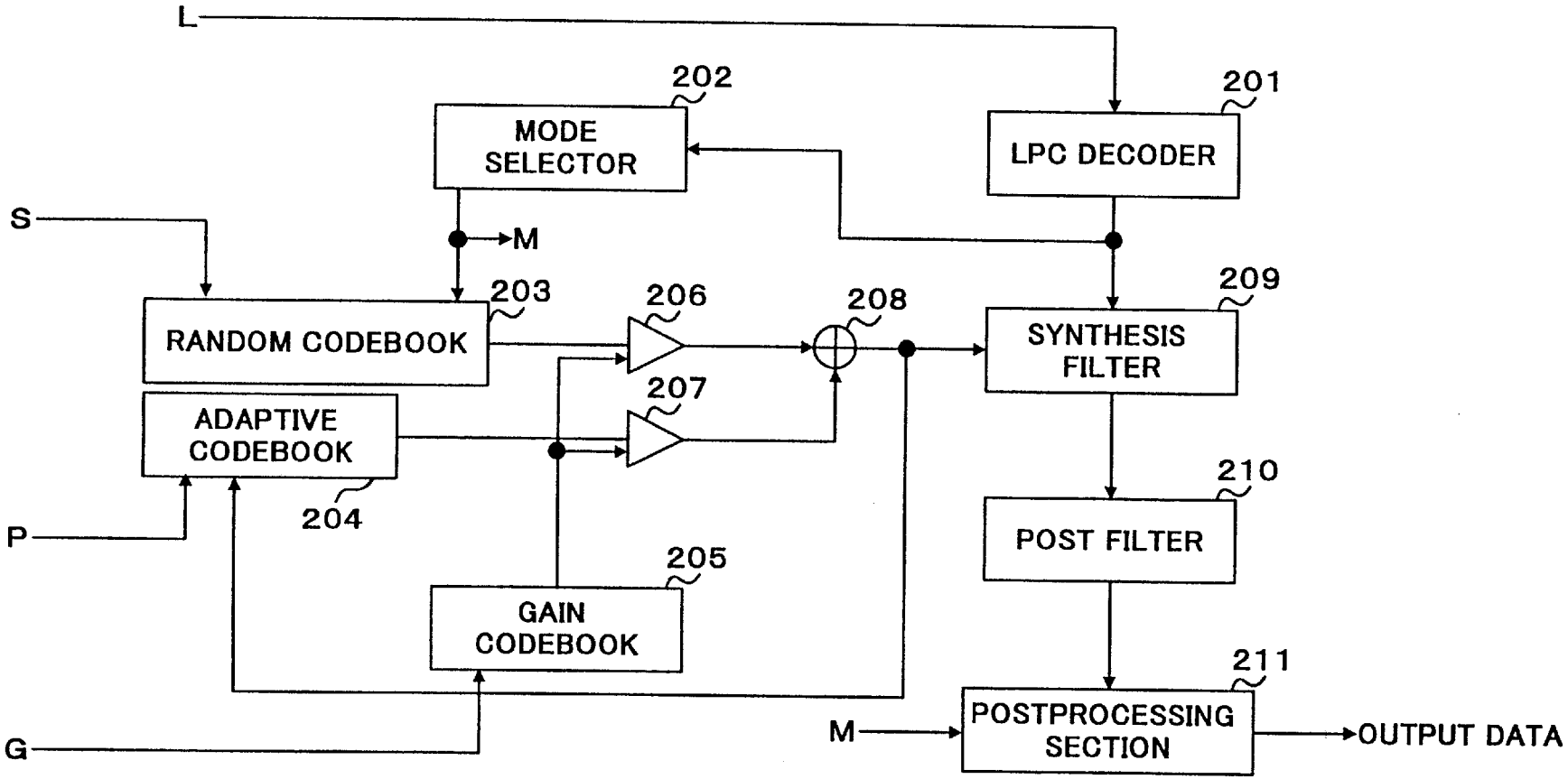
FIG. 2 is a block diagram illustrating a speech decoding apparatus in a second embodiment of the present invention.

FIG. 2 is a block diagram illustrating a configuration of a speech decoding apparatus according to the second embodiment of the present invention.

The code L representing quantized LPC, code S representing a random code vector, code P representing an adaptive code vector, and code G representing gain information, each transmitted from a coder, are respectively input to LPC decoder 201, random codebook 203, adaptive codebook 204 and gain codebook 205.

LPC decoder 201 decodes the quantized LPC from the code L to output to mode selector 202 and synthesis filter 209.

Mode selector 202 determines a mode for random codebook 203 and postprocessing section 211 using the quantized LPC input from LPC decoder 201, and outputs mode information M to random codebook 203 and postprocessing section 211. In addition, mode selector 202 also stores previously input information on quantized LPC, and performs the selection of mode using both characteristics of an evolution of quantized LPC between frames and of the quantized LPC in a current frame. There are at least two types of the modes, of which examples are a mode corresponding to a voiced speech segment, a mode corresponding to an unvoiced speech segment, and a mode corresponding to a stationary noise segment. Further, as information for use in selecting a mode, it is not necessary to use the quantized LPC themselves, and it is more effective to use converted parameters such as the quantized LSP, reflective coefficients and linear prediction residual power.

Random codebook 203 stores the predetermined number of random code vectors with different shapes, and outputs a random code vector designated by the random codebook index obtained by decoding the input code S. This random codebook 203 has at least two types of the modes. For example, random codebook 203 is configured to generate a pulse-like random code vector in the mode corresponding to a voiced speech segment, and further generate a noise-like random code vector in the modes corresponding to an unvoiced speech segment and steady noise segment. The random code vector output from random codebook 203 is generated with a single mode selected in mode selector 202 from among at least two types of the modes described above, and multiplied by the random codebook gain Gs in multiplier 206 to be output to adder 208.

Adaptive codebook 204 performs buffering while updating the previously generated excitation vector signal sequentially, and generates an adaptive code vector using the adaptive codebook index (pitch period (pitch lag)) obtained by decoding the input code P. The adaptive code vector generated in adaptive codebook 204 is multiplied by the adaptive codebook gain Ga in multiplier 207, and then output to adder 208.

Gain codebook 205 stores the predetermined number of sets of the adaptive codebook gain Ga and random codebook gain Gs (gain vector), and outputs the adaptive codebook gain component Ga and random codebook gain component Gs of the gain vector designated by the gain codebook index Gi obtained by decoding the input code G respectively to multipliers 207 and 206.

Adder 208 adds the random code vector and the adaptive code vector respectively input from multipliers 206 and 207 to generate the excitation vector signal, and outputs the generated excitation vector signal to synthesis filter 209 and adaptive codebook 204.

As synthesis filter 209, a LPC synthesis filter is constructed using the quantized LPC input from LPC decoder 201. With the constructed synthesis filter, the filtering processing is performed on the excitation vector signal input from adder 208, and the resultant signal is output to post filter 210.

Post filter 210 performs the processing to improve subjective qualities of speech signals such as pitch emphasis, formant emphasis, spectral tilt compensation and gain adjustment on the synthesized signal input from synthesis filter 209 to output to postprocessing section 211.

Postprocessing section 211 adaptively performs on the signal input from post filter 210 the processing to improve subjective qualities of the stationary noise segment such as inter-frame smoothing processing of spectral amplitude and randomizing processing of spectral phase using the mode information M input from mode selector 202. For example, the smoothing processing and randomizing processing is rarely performed in the modes corresponding to the voiced speech segment and unvoiced speech segment, and such processing is adaptively performed in the mode corresponding to, for example, the stationary noise segment. The postprocessed signal is output as output data such as a digital decoded speech signal.

In addition, although in this embodiment the mode information M output from mode selector 202 is used in both the mode selection for random codebook 203 and mode selection for postprocessing section 211, using the mode information M for either of the mode selections is also effective. In this case, the corresponding either one performs the multimode processing.

Figure 4:
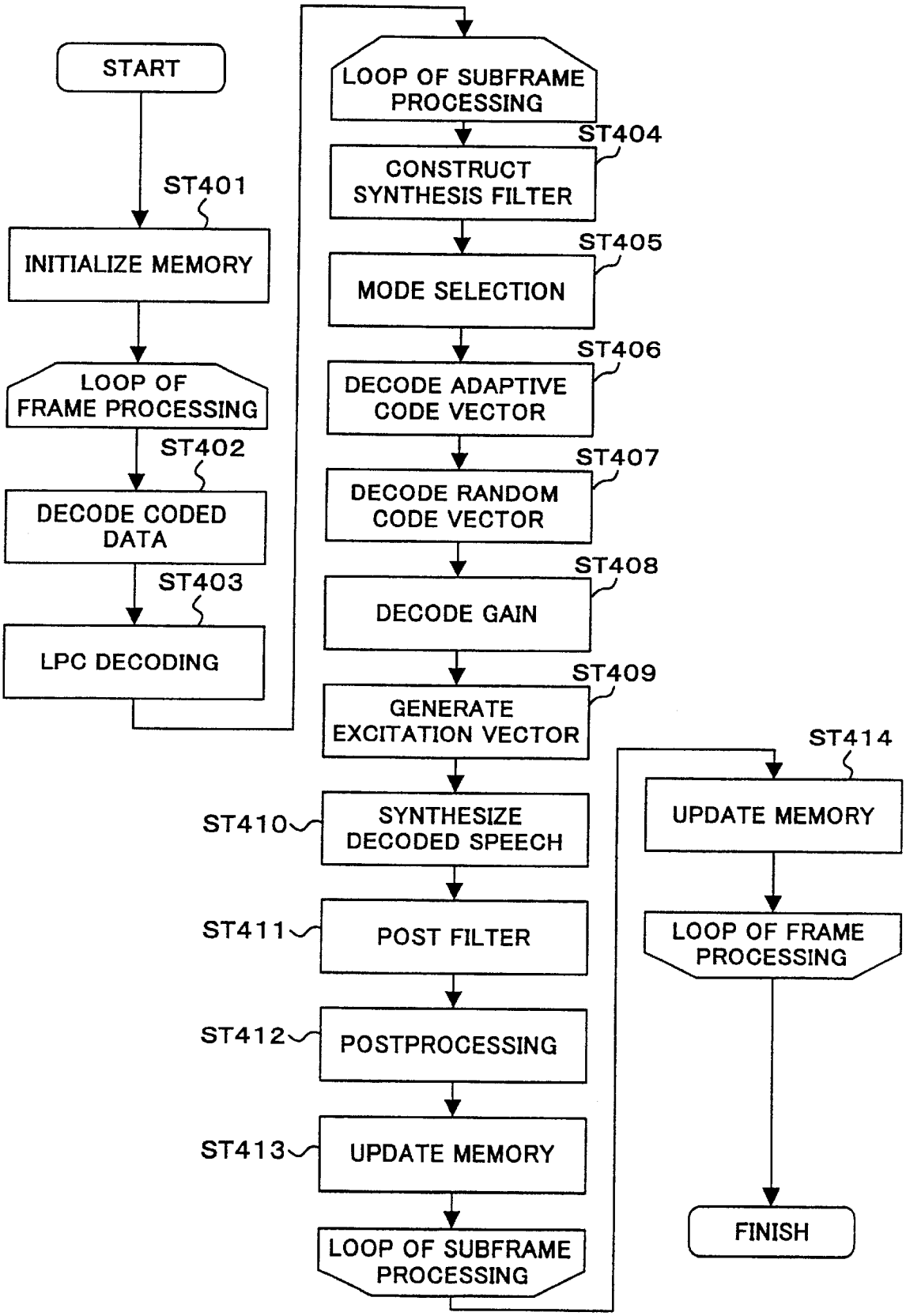
FIG. 4 is a flowchart for speech decoding processing in the second embodiment of the present invention.

The flow of the processing of the speech decoding method in the above-mentioned embodiment is next described with reference to FIG. 4. This explanation describes the case that in the speech coding processing, the processing is performed for each unit processing with a predetermined time length (frame with the time length of a few tens msec), and further the processing is performed for each shorter unit processing (subframe) obtained by dividing the frame into the integer number of lengths.

In ST401, all the memories such as the contents of the adaptive codebook, synthesis filter memory and output buffer are cleared.

Next, in ST402, coded data is decoded. Specifically, multiplexed received signals are demultiplexed, and the received signals constructed in bitstreams are converted into codes respectively representing quantized LPC, adaptive code vector, random code vector and gain information.

Next, in ST403, the LPC are decoded. The LPC are decoded from the code representing the quantized LPC obtained in ST402 with the reverse procedure of the quantization of the LPC described in the first embodiment.

Next, in ST404, the synthesis filter is constructed with the LPC decoded in ST403.

Next, in ST405, the mode selection for the random codebook and postprocessing is performed using the static and dynamic characteristics of the LPC decoded in ST403. Examples of specifically used characteristics are an evolution of quantized LSP, reflective coefficients calculated from the quantized LPC, and prediction residual power. The decoding of the random code vector and postprocessing is performed according to the mode selected in this step. There are at least two types of the modes, which are, for example, comprised of a mode corresponding to a voiced speech segment, mode corresponding to an unvoiced speech segment and mode corresponding to a stationary noise segment.

Next, in ST406, the adaptive code vector is decoded. The adaptive code vector is decoded by decoding a position from which the adaptive code vector is fetched from the adaptive codebook using the code representing the adaptive code vector, and fetching the adaptive code vector from the obtained position.

Next, in ST407, the random code vector is decoded. The random code vector is decoded by decoding the random codebook index from the code representing the random code vector, and retrieving the random code vector corresponding to the obtained index from the random codebook. When other processing such as pitch period processing of the random code vector is applied, a decoded random code vector is obtained after further being subjected to the pitch period processing. This random codebook has at least two types of the modes. For example, this random code book is configured to generate a pulse-like random code vector in the mode corresponding to a voiced speech segment, and further generate a noise-like random code vector in the modes corresponding to an unvoiced speech segment and stationary noise segment.

Next, in ST408, the adaptive codebook gain and random codebook gain are decoded. The gain information is decoded by decoding the gain codebook index from the code representing the gain information, and retrieving a pair of the adaptive codebook gain and random codebook gain instructed with the obtained index from the gain codebook.

Next, in ST409, the excitation vector signal is generated. The excitation vector signal is generated by adding a vector obtained by multiplying the adaptive code vector selected in ST406 by the adaptive codebook gain selected in ST408 and a vector obtained by multiplying the random code vector selected in ST407 by the random codebook gain selected in ST408.

Next, in ST410, a decoded signal is synthesized. The excitation vector signal generated in ST409 is filtered with the synthesis filter constructed in ST404, and thereby the decoded signal is synthesized.

Next, in ST411, the postfiltering processing is performed on the decoded signal. The postfiltering processing is comprised of the processing to improve subjective qualities of decoded signals, in particular, decoded speech signals, such as pitch emphasis processing, formant emphasis processing, spectral tilt compensation processing and gain adjustment processing.

Next, in ST412, the final postprocessing is performed on the decoded signal subjected to postfiltering processing. The postprocessing is comprised of the processing to improve subjective qualities of stationary noise segment in the decoded signal such as inter-(sub)frame smoothing processing of spectral amplitude and randomizing processing of spectral phase, and the processing corresponding to mode selected in ST405 is performed. For example, the smoothing processing and randomizing processing is rarely performed in the modes corresponding to the voiced speech segment and unvoiced speech segment, and such processing is performed in the mode corresponding to the stationary noise segment. The signal generated in this step becomes output data.

Next, in ST413, the update of the memory used in a loop of the subframe processing is performed. Specifically performed are the update of the adaptive codebook, and the update of states of filters used in the postfiltering processing.

In ST404 to ST413, the processing is performed on a subframe-by-subframe basis.

Next, in ST414, the update of memory used in a loop of the frame processing is performed. Specifically performed are the update of quantized (decoded) LPC buffer (in the case where the inter-frame predictive quantization of LPC is performed), and update of output data buffer.

In ST402 to 403 and ST414, the processing is performed on a frame-by-frame basis. Further, the processing on a frame-by-frame basis is iterated until the coded data is consumed.

(Third Embodiment)

Figure 5A:
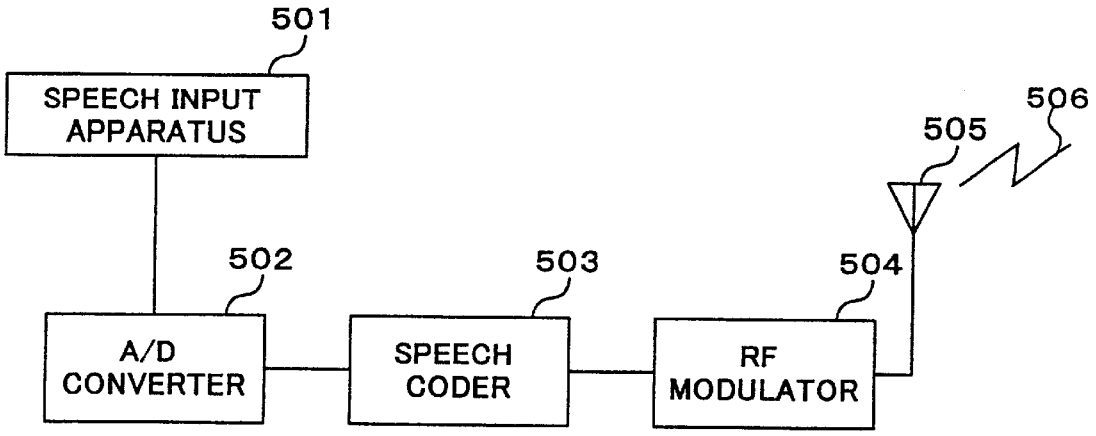
FIG. 5A is a block diagram illustrating a configuration of a speech signal transmission apparatus in a third embodiment of the present invention.
Figure 5B:
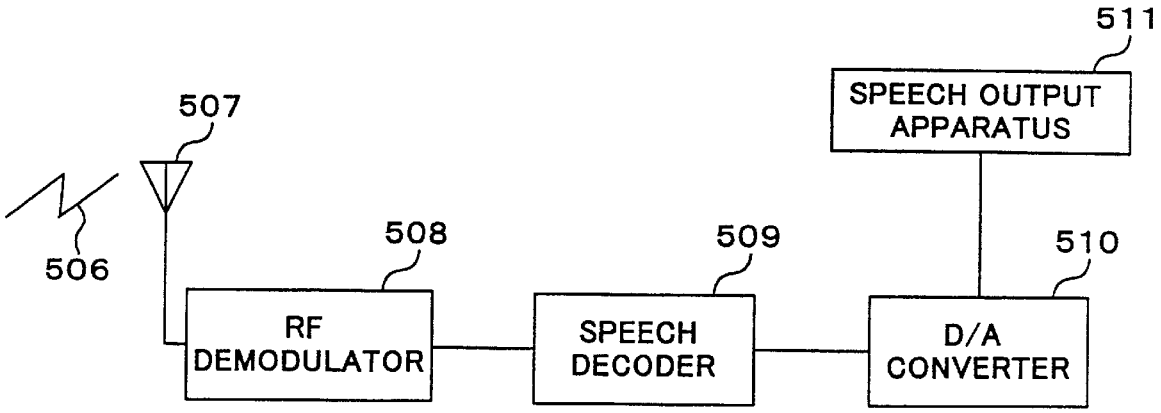
FIG. 5B is a block diagram illustrating a configuration of a speech signal reception apparatus in the third embodiment of the present invention.
Figure 6:
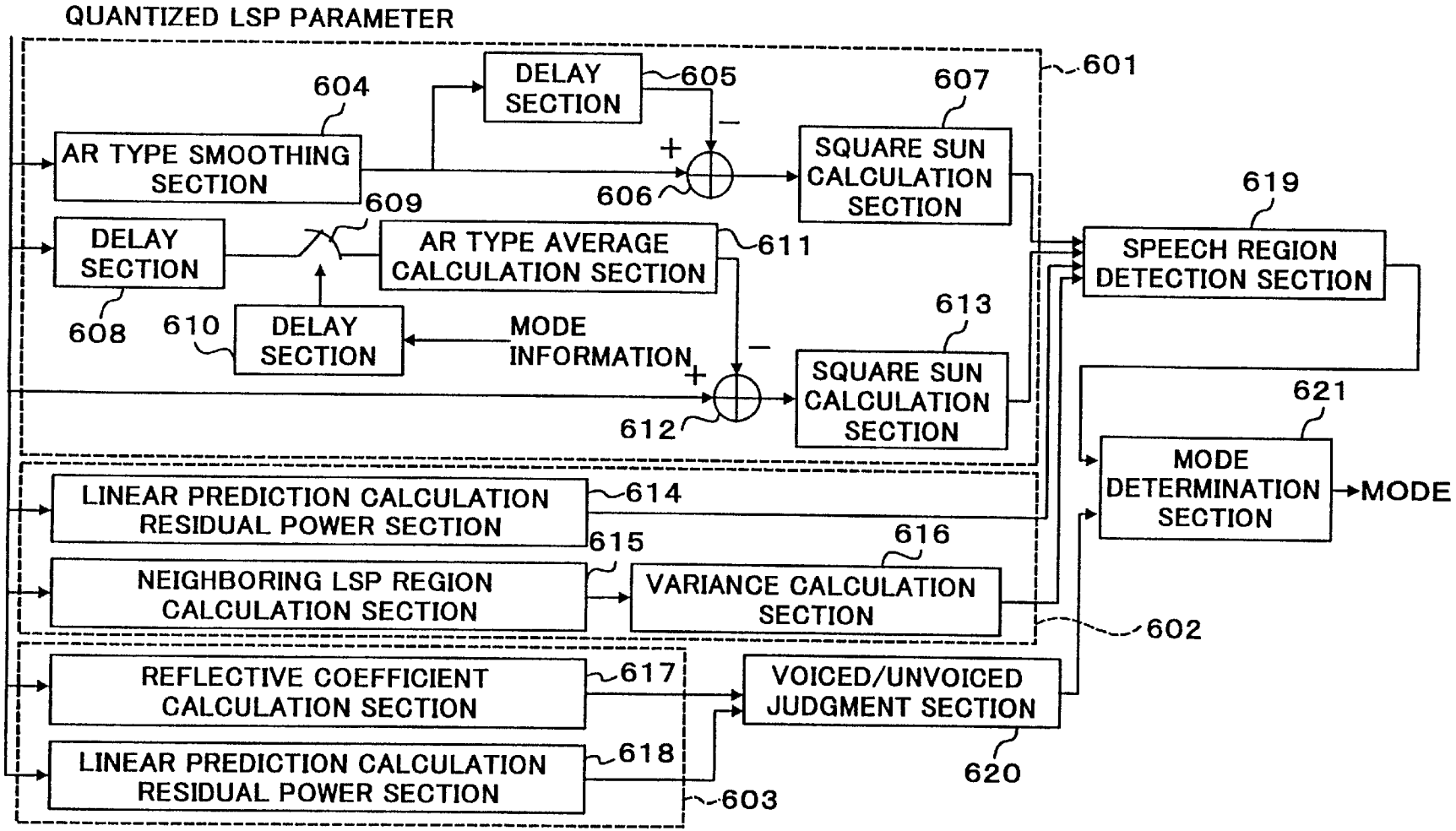
FIG. 6 is a block diagram illustrating a configuration of a mode selector in a fourth embodiment of the present invention.

FIG. 5 is a block diagram illustrating a speech signal transmission apparatus and reception apparatus respectively provided with the speech coding apparatus of the first embodiment 1 and speech decoding apparatus of the second embodiment 2. FIG. 5A illustrates the transmission apparatus, and FIG. 5B illustrates the reception apparatus.

In the speech signal transmission apparatus in FIG. 5A, speech input apparatus 501 converts a speech into an electric analog signal to output to A/D converter 501. A/D converter 502 converts the analog speech signal into a digital speech signal to output to speech coder 503. speech coder 503 performs speech coding processing on he input signal, and outputs coded information to RF modulator 504. R/F modulator 54 performs modulation, amplification and code spreading on the coded speech signal information to transmit as a radio signal, and outputs the resultant signal to transmission antenna 505. Finally, the radio signal (RF signal) 506 is transmitted from transmission antenna 505.

On the other hand, the reception apparatus in FIG. 5*b* receives the radio signal (RF signal) 506 with reception antenna 507, and outputs the received signal to RF demodulator 508. RF demodulator 508 performs the processing such as code de-spreading and demodulation to convert the radio signal into coded information, and outputs the coded information to speech decoder 509. Speech decoder 509 performs decoding processing on the coded information and outputs a digital decoded speech signal to D/A converter 510. D/A converter 510 converts the digital decoded speech signal output from speech decoder 509 into an analog decoded speech signal to output to speech output apparatus 511. Finally, speech output apparatus 511 converts the electric analog decoded speech signal into a decoded speech to output.

It is possible to use the above-mentioned transmission apparatus and reception apparatus as a mobile station apparatus and base station apparatus in mobile communication apparatuses such as portable telephones. In addition, the medium that transmits the information is not limited to the radio signal described in this embodiment, and it may be possible to use optical signals, and further possible to use cable transmission paths.

Further, it may be possible to achieve the speech coding apparatus described in the first embodiment, the speech decoding apparatus described in the second embodiment, and the transmission apparatus and reception apparatus described in the third embodiment by recording the corresponding program in a recording medium such as a magnetic disk, optomagnetic disk, and ROM cartridge to use as software The use of thus obtained recording medium enables a personal computer using such a recording medium to achieve the speech coding/decoding apparatus and transmission/reception apparatus.

(Fourth Embodiment)

The fourth embodiment describes examples of configurations of mode selectors 105 and 202 in the above-mentioned first and second embodiments.

The mode selector according this embodiment is provided with dynamic characteristic extraction section 601 that extracts the dynamic characteristic of quantized LSP parameters, and first and second static characteristic extraction sections 602 and 603 that extract the static characteristic of quantized LSP parameters.

Dynamic characteristic extraction section 601 receives an input quantized LSP parameter in AR type smoothing section 604 to perform smoothing processing. AR type smoothing section 604 performs the smoothing processing expressed with the following equation (1) on each order quantized LSP parameter, that is input for each unit processing time, as time sequence data:

$$Ls[i]: (1-\alpha)\times Ls_i+\alpha\times L_i,\ i=1, 2, \ldots, M,\ 0<\alpha<1 \quad (1)$$

Ls[i]: $i^{th}$ order smoothed quantized LSP parameter

L[i]: $i^{th}$ order quantized LSP parameter $\alpha$: smoothing coefficient

M: LSP analysis order

In addition, in the equation (1), the value of $\alpha$ is set at about 0.7 to avoid too strong smoothing. The smoothed quantized parameter obtained with the above equation (1) is branched to be input to adder 606 through delay section 605 and to be directly input to adder 606.

Delay section 605 delays the input smoothed quantized parameter by a unit processing time to output to adder 606.

Adder 606 receives the smoothed quantized LSP parameter at the current unit processing time, and the smoothed quantized LSP parameter at the last unit processing time. Adder 606 calculates an evolution between the smoothed quantized LSP parameter at the current unit processing time, and the smoothed quantized LSP parameter at the last unit processing time. The evolution is output for each order of LSP parameter. The result calculated by adder 606 is output to square sum calculation section 607.

Square sum calculation section 607 calculates the square sum of the evolution for each order between the smoothed quantized LSP parameter at the current unit processing time, and the smoothed quantized LSP parameter at the last unit processing time.

Dynamic characteristic extraction section 601 receives the quantized LSP parameter in delay section 608 in parallel with AR smoothing section 604. Delay section 608 delays the input quantized LSP parameter by a unit processing time to output to AR type average calculation section 611 through switch 609.

Switch 609 is connected when the mode information output from delay section 610 is the noise mode to operate to input the quantized LSP parameter output from delay section 608 to AR type average calculation section 611.

Delay section 610 receives the mode information output from mode determination section 621, and delays the input mode information by a unit processing time to output to switch 609.

AR type average calculation section 611 calculates the average LSP parameter over the noise region based on the equation (1) in the same way as AR type smoothing section 604 to output to adder 612. In addition, the value of $\alpha$ in the equation (1) is set at about 0.05 to perform extremely high smoothing processing, and thereby the long-time average of LSP parameter is calculated.

Adder 612 calculates an evolution for each order between the quantized LSP parameter at the current unit processing time, and the average quantized LSP parameter in the noise region calculated by AR type average calculation section 611.

Square sum calculation section 613 receives the difference information of quantized LSP parameters output from adder 612, and calculates the square sum for each order to output to speech region detection section 619.

Dynamic characteristic extraction 601 for quantized LSP parameter is comprised of components 604 to 613 as described above.

First static characteristic extraction section 602 calculates linear prediction residual power from the quantized LSP parameter in linear prediction residual power calculation section 614, and further calculates a region between neighboring orders of the quantized LSP parameters as expressed in the following equation (2) in neighboring LSP region calculation section 615:

$$Ld[i]=L[i+1]-L[i],\ i=1, 2, \ldots, M-1 \quad (2)$$

L[i]: $i^{th}$ order quantized LSP parameter calculation section 615 is provided to variance calculation section 616. Variance calculation section 616 calculates the variance of quantized LSP parameter regions output from neighboring LSP region calculation section 615. At the time the variance is calculated, it is possible to reflect characteristics of peak and valley except the peak at the lowest frequency, by eliminating the data of the lowest frequency (Ld [1]) without using all the data of LSP parameter regions. With respect to a stationary noise with the characteristic such that levels at a low frequency band are lifted, when such a noise is passed through the high-pass filter, since a peak of the spectrum always appears around the cut-off frequency of the filter, it is effective to cancel the information of such a peak of the spectrum. In other words, it is possible to extract the characteristics of peak and valley of the spectral envelop of an input signal, and therefore to extract the static characteristics to detect a region with high possibility that the region is a speech region. Further, according to this constitution, it is possible to separate the speech region and stationary noise region with high accuracy.

First static characteristic extraction section 602 for quantized LSP parameter is comprised of components 614, 615 and 616 as described above.

In second static characteristic extraction section 603, reflective coefficient calculation section 617 converts the quantized LSP parameter into a reflective coefficient to output to voiced/unvoiced judgment section 620. Concurrently with the above processing, linear prediction residual power calculation section 618 calculates the linear prediction residual power from the quantized LSP parameter to output to voiced/unvoiced judgment section 620.

In addition, since linear prediction residual power calculation section 618 is the same as linear prediction residual power calculation section 614, it is possible to share one component as the sections 614 and 618.

Second static characteristic extraction section 603 for quantized LSP parameter is comprised of components 617 and 618 as described above.

Outputs from dynamic characteristic extraction section 601 and first static characteristic extraction section 602 are provided to speech region detection section 619. Speech region detection section 619 receives an evolution amount of the smoothed quantized LSP parameter input from square sum calculation section 607, a distance between the average quantized LSP parameter of the noise segment and the current quantized LSP parameter input from square sum calculation section 613, the quantized linear prediction residual power input from linear prediction residual power calculation section 614, and the variance information of the neighboring LSP region data input from variance calculation section 616. Then, using these information, speech region detection section 619 judges whether or not an input signal (or a decoded signal) at the current unit processing time is a speech region, and outputs the judged result to mode determination section 621. The more specific method for judging whether the input signal is a speech region is descried later using FIG. 8.

On the other hand, an output from second characteristic extraction section 603 is provided to voiced/unvoiced judgment section 620. Voiced/unvoiced judgment section 620 receives the reflective coefficient input from reflective coefficient calculation section 617, and the quantized linear prediction residual power input from linear prediction residual power calculation section 618. Then, using these information, voiced/unvoiced judgment section 620 judges whether the input signal (decoded signal) at the current unit processing time is a voiced region or unvoiced region, and outputs the judged result to mode determination section 621. The more specific voiced/unvoiced judgment method is descried later using FIG. 9.

Mode determination section 621 receives the judged result output from speech region detection section 619 and the judged result output from voiced/unvoiced judgment section 620, and using these information, determines a mode of the input signal (or decoded signal) at the current unit processing time to output. The more specific mode classifying method is described later using FIG. 10.

In addition, although AR type sections are used as the smoothing section and average calculation section in this embodiment, it may be possible to perform the smoothing and average calculation by using other methods.

Figure 8:
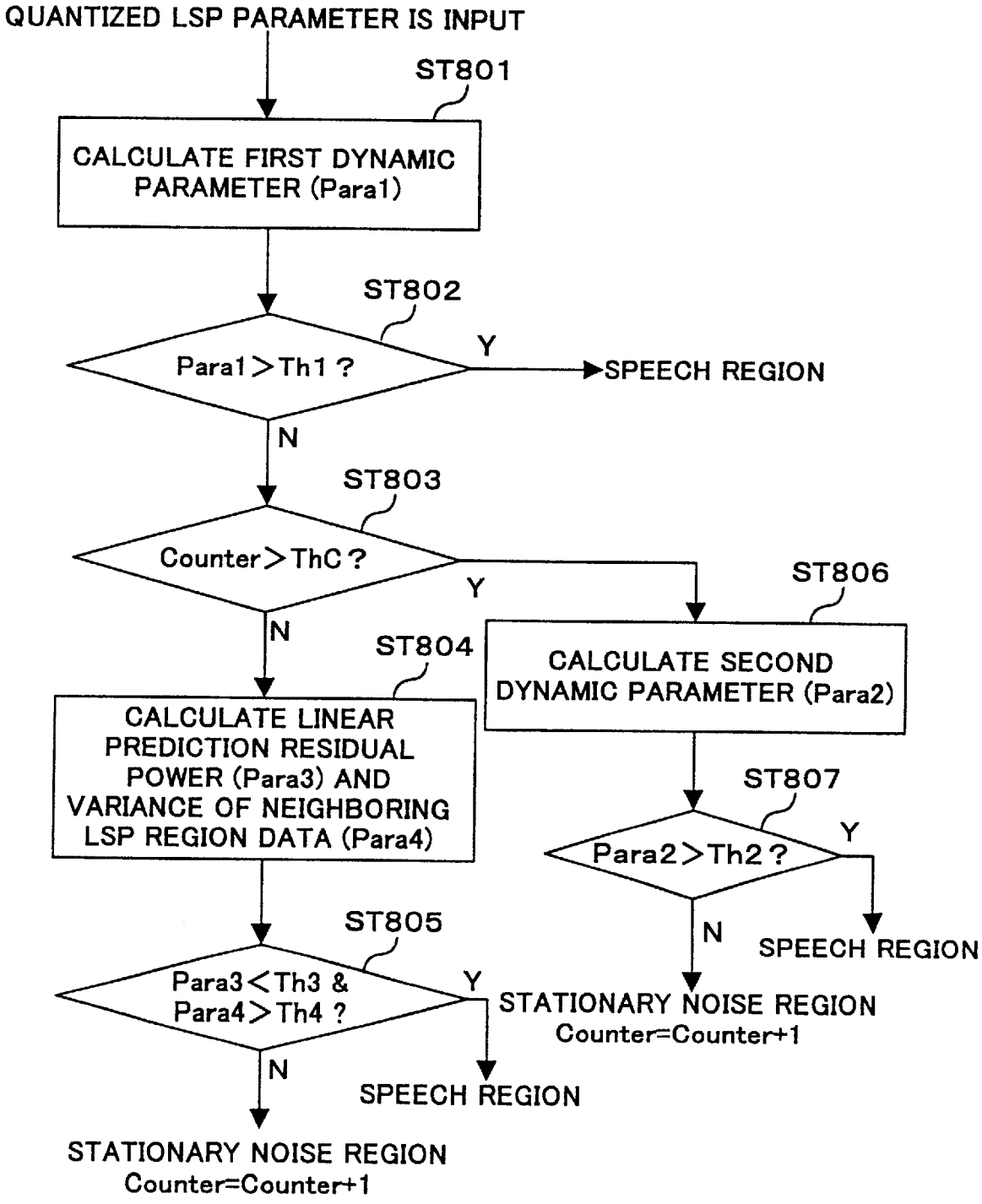
FIG. 8 is a flowchart for the former part of multimode postprocessing in the fourth embodiment of the present invention.

The detail of the speech region judgment method in the above-mentioned embodiment is next explained with reference to FIG. 8.

First, in ST801, the first dynamic parameter (Paral) is calculated. The specific contents of the first dynamic parameter is an evolution amount of quantized LSP parameter for each unit processing time, and expressed with the following equation (3):

$$D(t)=\Sigma_{i=1}^{M}(LSi(t)-LSi(t-1))^2 \quad (3)$$

LSi(t): smoothed quantized LSP at time t

Next, in ST802, it is checked whether or not the first dynamic parameter is larger than a predetermined threshold Th1. When the parameter exceeds the threshold Th1, since the evolution amount of the quantized LSP parameter is large, it is judged that the input signal is a speech region. On the other hand, when the parameter is equal to or less than the threshold Th1, since the evolution amount of the quantized LSP parameter is small, the processing proceeds to ST803, and further proceeds to steps for judgment processing with other parameter.

In ST802, when the first dynamic parameter is equal to or less than the threshold Th1, the processing proceeds to ST803, where the number of a counter indicative of the number of times the stationary noise region is judged previously. The initial value of the counter is 0, and is incremented by 1 for each unit processing time judged as the stationary noise region with the mode determination method. In ST803, when the number of the counter equals to or less than a predetermined threshold ThC, the processing proceeds to ST804, where it is judged whether or not the input signal is a speech region using the static parameter. On the other hand, when the number of the counter exceeds the threshold ThC, the processing proceeds to ST806, where it is judged whether or not the input signal is a speech region using the second dynamic parameter.

Two types of parameters are calculated in ST804. One is the linear prediction residual power (Para3) calculated from the quantized LSP parameters, and the other is the variance of the difference information of neighboring orders of quantized LSP parameters (Para4).

The linear prediction residual power is obtained by converting the quantized LSP parameters into the linear predictive coefficients and using the relation equation in the algorithm of Levinson-Durbin. It is known that the linear prediction residual power tends to be higher at an unvoiced segment than at a voiced segment, and therefore the linear prediction residual power is used as a criterion of the voiced/unvoiced judgment. The difference information of neighboring orders of quantized LSP parameters is expressed with the equation (2), and the variance of such data is obtained. However there are some cases, which are depending on the types of noises and bandwidth limitation, of existing the spectral peak at the lowest frequency band. Therefore it is preferable to obtain the variance using the data from i=2 to M−1 (M is analysis order) in the equation (2) without using the difference information of neighboring orders at the low frequency edge (i=1 in the equation (2)). In the speech signal, since there are about three formants at a telephone band (200 Hz to 3.4 kHz), the LSP regions have wide portions and narrow portions, and therefore the variance of the region data tends to be increased. On the other hand, in the stationary noise, since there is no formant structure, the LSP regions usually have relatively equal regions, and therefore such a variation tends to be decreased. By the use of these characteristics, it is possible to judge whether or not the input signal is a speech region. However, there is the case that some type of noise has the spectral peak at a low frequency band as described previously. In this case, the LSP region at the lowest frequency band becomes narrow, and therefore the variance obtained by using all the neighboring LSP evolution data decreases the difference caused by the presence or absence of the formant structure, thereby lowering the judgment accuracy. Accordingly, obtaining the variance with the neighboring LSP difference information at the low frequency edge eliminated prevents such deterioration of the accuracy. However, since such a static parameter has lower judgment ability than the dynamic parameter, it is preferable to use the static parameter as supplementary information. Two types of parameters calculated in ST804 are used in ST805.

Next, in ST805, two types of parameters calculated in ST804 are processed with a threshold. Specifically, in the case where the linear prediction residual power (Para3) is equal to or less than a threshold Th3, and the variance (Para4) of neighboring LSP region data is equal to or more than a threshold Th4, it is judged that the input signal is a speech region. In other cases, it is judged that the input signal is a stationary noise region (non-speech region). When the stationary noise region is judged, the value of the counter is incremented by 1.

In ST806, the second dynamic parameter (Para2) is calculated. The second dynamic parameter is a parameter indicative of a similarity degree between the average quantized LSP parameter in a previous stationary noise region and the quantized LSP parameter in the current unit processing time, and specifically, as expressed in the equation (4), is obtained as the square sum of different values obtained for each order using the above-mentioned two types of quantized LSP parameters:

$$E(t)=\Sigma_{i=1}^{M}(Li(t)-LAi)^2 \quad (4)$$

Li(t): quantized LSP at time t

LAi: average quantized LSP of a noise region

The obtained second dynamic parameter is processed with the threshold in ST807.

Next, in ST807, it is determined whether or not the second dynamic parameter exceeds the threshold Th2. When the second dynamic parameter exceeds the threshold Th2, since the similarity degree to the average quantized LSP parameter in the previous stationary noise region is low, it is judged that the input signal is the speech region. When the second dynamic parameter is equal to or less than the threshold Th2, since the similarity degree to the average quantized LSP parameter in the previous stationary noise region is high, it is judged that the input signal Is the stationary noise region. The value of the counter is incremented by 1 when the input signal is judged as the stationary noise region.

Figure 9:
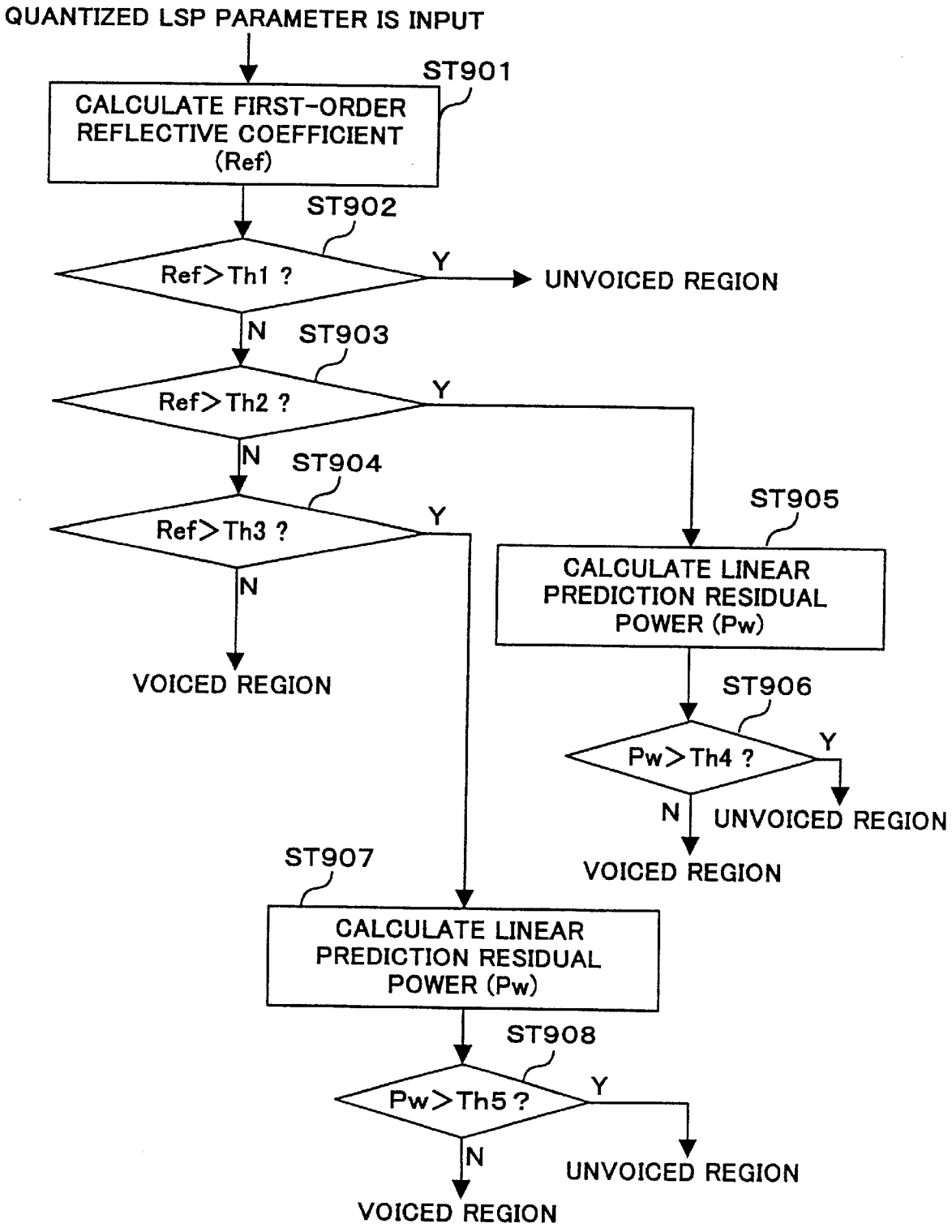
FIG. 9 is a flowchart for the latter part of the multimode postprocessing in the fourth embodiment of the present invention.

The detail of the voiced/unvoiced region judgment method in the above-mentioned embodiment is next explained with reference to FIG. 9.

First, in ST901, first-order reflective coefficient is calculated from the quantized LSP parameter in the current unit processing time. The reflective coefficient is calculated after the LSP parameter is converted into the linear predictive coefficient.

Next, in ST902, it is determined whether or not the above-mentioned reflective coefficient exceeds the first threshold Th1. When the coefficient exceeds the threshold Th1, it is judged that the current unit processing time is the unvoiced region, and the voiced/unvoiced judgment processing is finished. When the coefficient is equal to or less than the threshold Th1, the voiced/unvoiced judgment processing is further continued.

When the region is not judged as the unvoiced region in ST902, in ST903, it is determined whether or not the above-mentioned reflective coefficient exceeds the second threshold Th2. When the coefficient exceeds the threshold Th2, the processing proceeds to ST905, and when the coefficient is equal to or less than the threshold Th2, the processing proceeds to ST904.

When the above-mentioned reflective coefficient is equal or less than the second threshold Th2 in ST903, in ST904, it is determined whether or not the above-mentioned reflective coefficient exceeds the third threshold Th3. When the coefficient exceeds the threshold Th3, the processing proceeds to ST907, and when the coefficient is equal to or less than the threshold Th3, the region is judged as the speech region, and the voiced/unvoiced judgment processing is finished.

When the above-mentioned reflective coefficient exceeds the second threshold Th2 in ST903, the linear prediction residual power is calculated in ST905. The linear prediction residual power is calculated after the quantized LSP is converted into the linear predictive coefficient.

In ST906, following ST905, it is determined whether or not the above-mentioned linear prediction residual power exceeds the threshold Th4. When the power exceeds the threshold Th4, it is judged that the region is the unvoiced region, and the voiced/unvoiced judgment processing is finished. When the power is equal to or less than the threshold Th4, it is judged that the region is the speech region, and the voiced/unvoiced judgment processing is finished.

When the above-mentioned reflective coefficient exceeds the third threshold Th3 in ST904, the linear prediction residual power is calculated in ST907.

In ST908, following ST907, it is determined whether or not the above-mentioned linear prediction residual power exceeds the threshold Th5. When the power exceeds the threshold Th5, it is judged that the region is the unvoiced region, and the voiced/unvoiced judgment processing is finished. When the power is equal to or less than the threshold Th5, it is judged that the region is the speech region, and the voiced/unvoiced judgment processing is finished.

Figure 10:
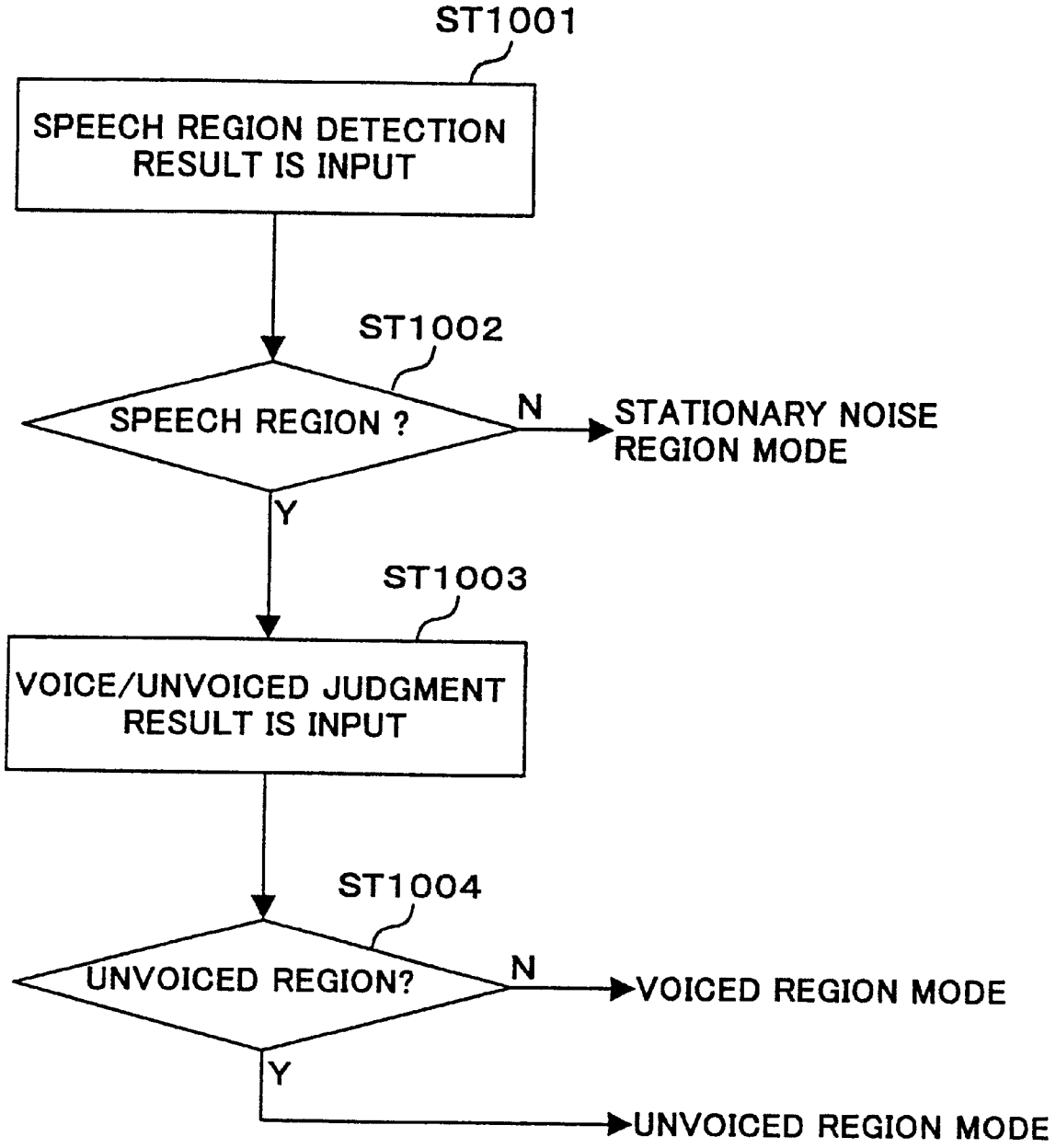
FIG. 10 is a flowchart for the entire part of the multimode postprocessing in the fourth embodiment of the present invention.

The mode determination method used in mode determination section 621 is next explained with reference to FIG. 10.

First, in ST1001, the speech region detection result is input. This step may be a block itself that performs the speech region detection processing.

Next, in ST1002, it is determined whether to determine that a mode is the stationary noise mode, based on the judgment result on whether or not the region is the speech region. When the region is the speech region, the processing proceeds to ST1003. When the region is not the speech region (stationary noise region), the mode determination result indicative of the stationary noise mode is output, and the mode determination processing is finished.

When it is determined that the region is not the stationary noise mode in ST1002, the voiced/unvoiced judgment result is input in ST1003. This step may be a block itself that performs the voiced/unvoiced determination processing.

Following ST1003, the mode determination is performed to determine whether the mode is the voiced region mode or the unvoiced region mode based on the voiced/unvoiced judgment result ST1004. When the judgment result is indicative of the voiced region, the mode determination result indicative of the voiced region mode is output, and the mode determination processing is finished. When the voiced/unvoiced judgment result is indicative of the unvoiced region, the mode determination result indicative of the unvoiced region mode is output, and the mode determination processing is finished. As described above, using the speech region detection result and the voiced/unvoiced judgment, the modes of the input signals (or decoded signals) in a current unit processing block are classified into three modes.

(Fifth Embodiment)

Figure 7:
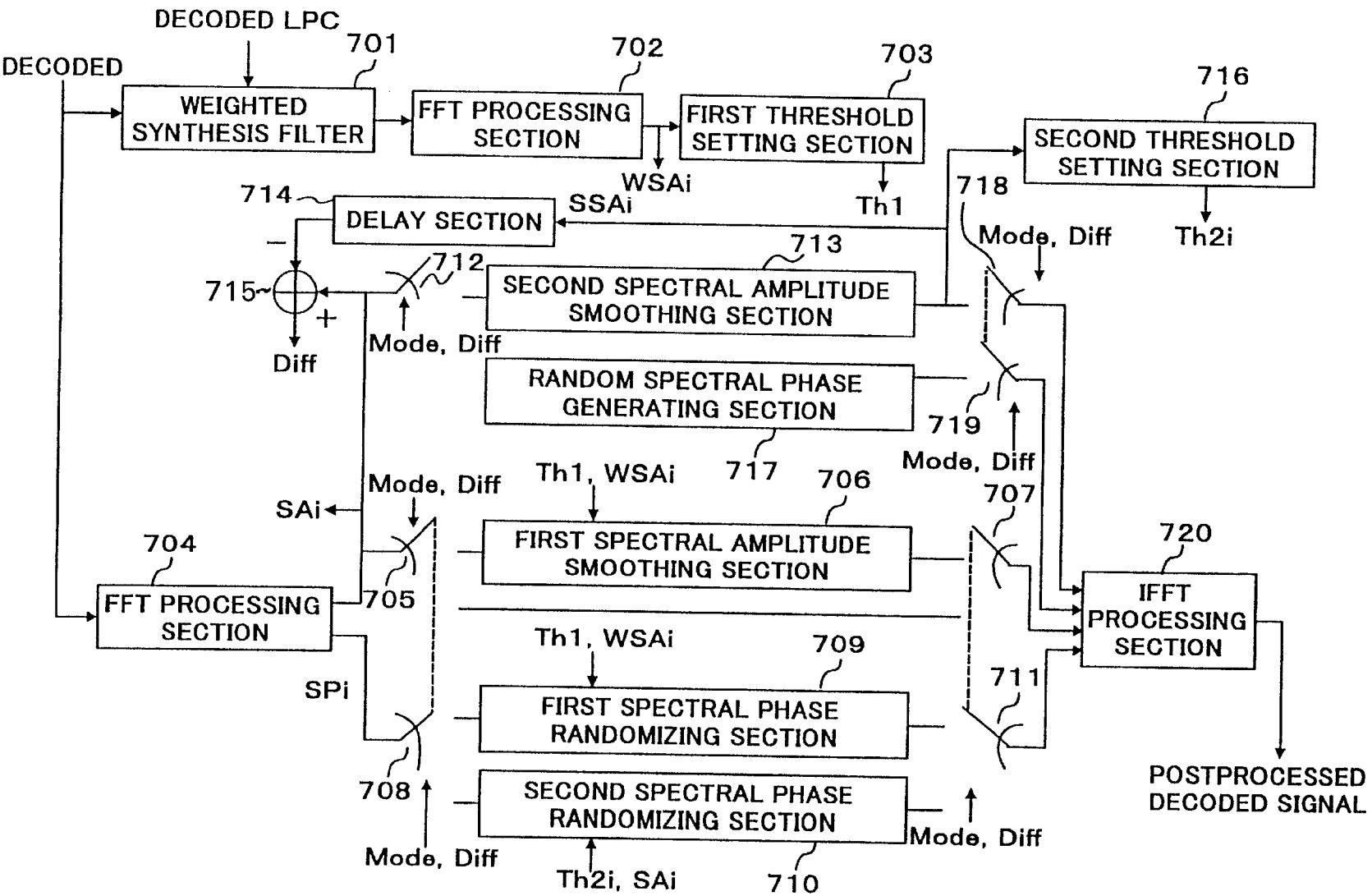
FIG. 7 is a block diagram illustrating a configuration of a multimode postprocessing section in a fifth embodiment of the present invention.

FIG. 7 is a block diagram illustrating a configuration of a postprocessing section according to the fifth embodiment of the present invention. The postprocessing section is used in the speech signal decoding apparatus described in the second embodiment with the mode selector, described in the fourth embodiment, combined therewith. The postprocessing section illustrated in FIG. 7 is provided with mode selection switches 705, 708, 707 and 711, spectral amplitude smoothing section 706, spectral phase randomizing sections 709 and 710, and threshold setting sections 703 and 716.

Weighted synthesis filter 701 receives decoded LPC output from LPC decoder 201 in the previously described speech decoding apparatus to construct the perceptual weighted synthesis filter, performs weighted filtering processing on the synthesized speech signal output from synthesis filter 209 or post filter 210 in the speech decoding apparatus to output to FFT processing section 702.

FFT processing section 702 performs FFT processing on the weighting-processed decoded signal output from weighted synthesis filter 701, and outputs a spectral amplitude WSAi to first threshold setting section 703, first spectral amplitude smoothing section 706 and first spectral phase randomizing section 709.

First threshold setting section 703 calculates the average of the spectral amplitude calculated in FFT processing section 702 using all frequency signal components, and using the calculated average as a reference, outputs the threshold Th1 to first spectral amplitude smoothing section 706 and first spectral phase randomizing section 709.

FFT processing section 704 performs FFT processing on the synthesized speech signal output from synthesis filter 209 and post filter 210 in the speech decoding apparatus, outputs the spectral amplitude to mode selection switches 705 and 712, adder 715, and second spectral phase randomizing section 710, and further outputs the spectral phase to mode selection switch 708.

Mode selection switch 705 receives the mode information (Mode) output from mode selector 202 in the speech decoding apparatus, and the difference information (Diff) output from adder 715, and judges whether the decoded signal in the current unit processing time is the speech region or the stationary noise region. Mode selection switch 705 connects to mode selection switch 707 when judges that the decoded signal is the speech region, while connecting to first spectral amplitude smoothing section 706 when judges that the decoded signal is the stationary noise region.

First spectral amplitude smoothing section 706 receives the spectral amplitude SAi output from FFT processing section 704 through mode selection switch 705, and performs smoothing processing on a signal component with a frequency determined by the input first threshold Th1 and weighted spectral amplitude WSAi to output to mode selection switch 707. The determination of the signal component with the frequency to be processed for smoothing is performed by determining whether the weighted spectral amplitude WSAi is equal to or less than the first threshold Th1. In other words, the smoothing processing of the spectral amplitude SAi is performed on the signal component with the frequency i such that WSAi is equal to or less than Th1. The smoothing processing reduces the discontinuity in time of the spectral amplitude caused by the coding distortion. In the case where the smoothing processing is performed with the AR type expressed with the equation (1), the coefficient $\alpha$ can be set at about 0.1 when the number of FFT points is 128, and the unit processing time is 10 ms.

As mode selection switch 705, mode selection switch 707 receives the mode information (Mode) output from mode selector 202 in the speech decoding apparatus, and the difference information (Diff) output from adder 715, and judges whether the decoded signal in the current unit processing time is the speech region or the stationary noise region. Mode selection switch 707 connects to mode selection switch 705 when judges that the decoded signal is the speech region, while connecting to first spectral amplitude smoothing section 706 when judges that the decoded signal is the stationary noise region. The judgment result is the same as that by mode selection switch 705. An output of mode selection switch 707 is connected to IFFT processing section 720.

Mode selection switch 708 is a switch of which the output is switched synchronously with mode selection switch 705. Mode selection switch 708 receives the mode information (Mode) output from mode selector 202 in the speech decoding apparatus, and the difference information (Diff) output from adder 715, and judges whether the decoded signal in the current unit processing time is the speech region or the stationary noise region. Mode selection switch 708 connects to second spectral phase randomizing section 710 when judges that the decoded signal is the speech region, while connecting to first spectral phase randomizing section 709 when judges that the decoded signal is the stationary noise region. The judgment result is the same as that by mode selection switch 705. In other words, mode selection switch 708 is connected to first spectral phase randomizing section 709 when mode selection switch 705 is connected to first spectral amplitude smoothing section 706, and mode selection switch 708 is connected to second spectral phase randomizing section 710 when mode selection switch 705 is connected to mode selection switch 707.

First spectral phase randomizing section 709 receives the spectral phase SPi output from FFT processing section 704 through mode selection switch 708, and performs randomizing processing on a signal component with a frequency determined by the input first threshold Th1 and weighted spectral amplitude WSAi to output to mode selection switch 711. The method for determining the signal component at the frequency to be processed for randomizing is the same way as that for determining the signal component at the frequency to be processed for smoothing in first spectral amplitude smoothing section 706. In other words, the randomizing processing of spectral phase SPi is performed on the signal component with the frequency i such that WSAi is equal to or less than Th1.

Second spectral phase randomizing section 710 receives the spectral phase SPi output from FFT processing section 704 through mode selection switch 708, and performs randomizing processing on a signal component with a frequency determined by the input second threshold Th2*i* and spectral amplitude SAi to output to mode selection switch 711. The method for determining the signal component at the frequency to be processed for randomizing is similar to that in first spectral phase randomizing section 709. In other words, the randomizing processing of spectral phase SPi is performed on the signal component with the frequency i such that SAi is equal to or less than Th2*i*.

Mode selection switch 711 operates synchronously with mode selection switch 707. As mode selection switch 707, mode selection switch 710 receives the mode information (Mode) output from mode selector 202 in the speech decoding apparatus, and the difference information (Diff) output from adder 715, and judges whether the decoded signal in the current unit processing time is the speech region or the stationary noise region. Mode selection switch 711 connects to second spectral phase randomizing section 710 when judges that the decoded signal is the speech region, while connecting to first spectral phase randomizing section 709 when judges that the decoded signal is the stationary noise region. The judgment result is the same as that by mode selection switch 708. An output of mode selection switch 711 is connected to IFFT processing section 720.

As mode selection switch 705, mode selection switch 712 receives the mode information (Mode) output from mode selector 202 in the speech decoding apparatus, and the difference information (Diff) output from adder 715, and judges whether the decoded signal in the current unit processing time is the speech region or the stationary noise region. When it is judged that the decoded signal is not the speech region (is the stationary noise region), mode selection switch 712 is connected to output the spectral amplitude SAi output from FFT processing section 704 to second spectral amplitude smoothing section 713. When it is determined that the decoded signal is the speech region, mode selection switch 712 is disconnected, and therefore the spectral amplitude SAi is not output to second spectral amplitude smoothing section 713.

Second spectral amplitude smoothing section 713 receives the spectral amplitude SAi output from FFT processing section 704 through mode selection switch 712, and performs the smoothing processing on signal components at all frequency bands. The average spectral amplitude in the stationary noise region can be obtained by this smoothing processing. The smoothing processing is the same as that in first spectral amplitude smoothing section 706. In addition, when mode selection switch 712 is disconnected, the section 713 does not perform the processing, and a smoothed spectral amplitude SSAi of the stationary noise region, which is last processed, is output. The smoothed spectral amplitude SSAi processed in second spectral amplitude smoothing processing section 713 is output to delay section 714, second threshold setting section 716, and mode selection switch 718.

Delay section 714 delays the input SSAi, output from second spectral amplitude smoothing section 713, by a unit processing time to output to adder 715.

Adder 715 calculates a difference between the smoothed spectral amplitude SSAi of the stationary noise region in the last unit processing time and the spectral amplitude SAi in the current unit processing time to output to mode switches 705, 707, 708, 711, 712, 718, and 719.

Second threshold setting section 716 sets the threshold Th2*i* using as a reference the smoothed spectral amplitude SSAi of the stationary noise region output from second spectral amplitude smoothing section 713 to output to second spectral phase randomizing section 710.

Random spectral phase generating section 717 outputs a randomly generated spectral phase to mode selection switch 719.

As mode selection switch 712, mode selection switch 718 receives the mode information (Mode) output from mode selector 202 in the speech decoding apparatus, and the difference information (Diff) output from adder 715, and judges whether the decoded signal in the current unit processing time is the speech region or the stationary noise region. When it is judged that the decoded signal is the speech region, mode selection switch 718 is connected to output an output from second spectral amplitude smoothing section 713 to IFFT processing section 720. When it is determined that the decoded signal is not the speech region (stationary noise region), mode selection switch 718 is disconnected, and therefore the output from second spectral amplitude smoothing section 713 is not output to IFFT processing section 720.

Mode selection switch 719 is switched synchronously with mode selection switch 718. As mode selection switch 718, mode selection switch 719 receives the mode information (Mode) output from mode selector 202 in the speech decoding apparatus, and the difference information (Diff) output from adder 715, and judges whether the decoded signal in the current unit processing time is the speech region or the stationary noise region. When it is judged that the decoded signal is the speech region, mode selection switch 719 is connected to output an output from random spectral phase generating section 717 to IIFFT processing section 720. When it is judged that the decoded signal is not the speech region (is stationary noise region), mode selection switch 719 is disconnected, and therefore the output from second random spectral phase generating section 717 is not output to IFFT processing section 720.

IFFT processing section 720 receives the spectral amplitude output from mode selection switch 707, the spectral phase output from mode selection switch 711, the spectral amplitude output from mode selection switch 718, and the spectral phase output from mode selection section 719 to perform IFFT processing, and outputs the processed signal. When mode selection switches 718 and 719 are disconnected, IFFT processing section 720 transforms the spectral amplitude input from mode selection 707 and the spectral phase input from mode selection switch 711 into a real part spectrum and imaginary part spectrum of FFT, then performs the IFFT processing, and outputs the real part of the resultant as a time signal. On the other hand, when mode selection switches 718 and 719 are connected, IFFT processing section 720 transforms the spectral amplitude input from mode selection 707 and the spectral phase input from mode selection switch 711 into a first real part spectrum and first imaginary part spectrum, and further transforms the spectral amplitude input from mode selection 718 and the spectral phase input from mode selection switch 719 into a second real part spectrum and second imaginary part spectrum to add, and then performs the IFFT processing. In other words, assuming that a third real part is obtained by adding the first real part spectrum to the second real part spectrum, and that a third imaginary part is obtained by adding the first imaginary part spectrum to the second imaginary part spectrum, the IFFT processing is performed using the third real part spectrum and third imaginary part spectrum. At the time of adding the above-mentioned spectra, the second real part spectrum and second imaginary part spectrum are attenuated by constant times or an adaptively controlled variable. For example, at the time of adding the above-mentioned spectra, the second real part spectrum is multiplied by 0.25 and then added to the first real part spectrum, and the second imaginary part spectrum is multiplied by 0.25, and then added to the first imaginary part spectrum, thereby obtaining the third real part spectrum and third imaginary part spectrum.

Figure 11:
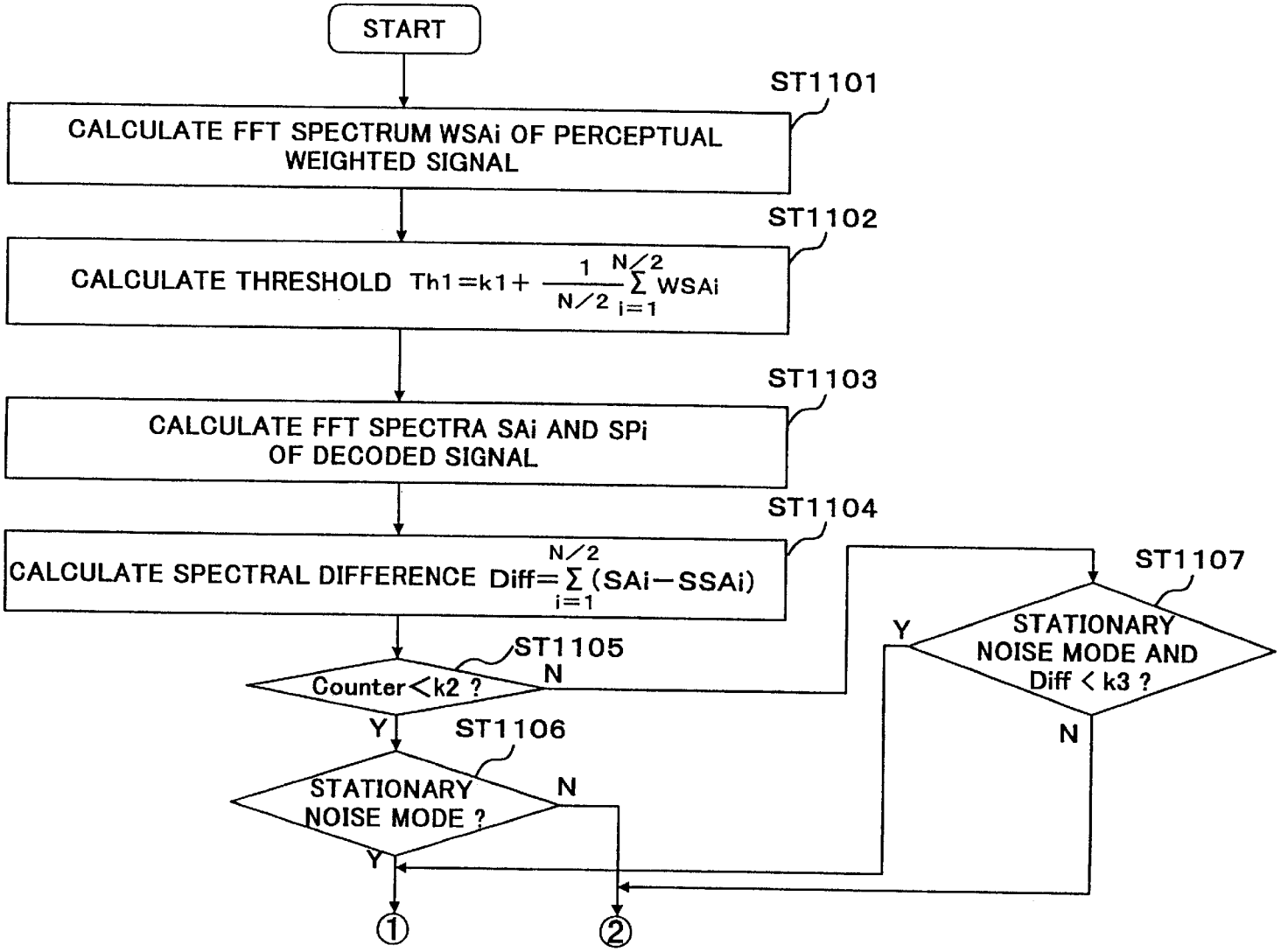
FIG. 11 is a flowchart for the former part of the multimode postprocessing in the fifth embodiment of the present invention.
Figure 12:
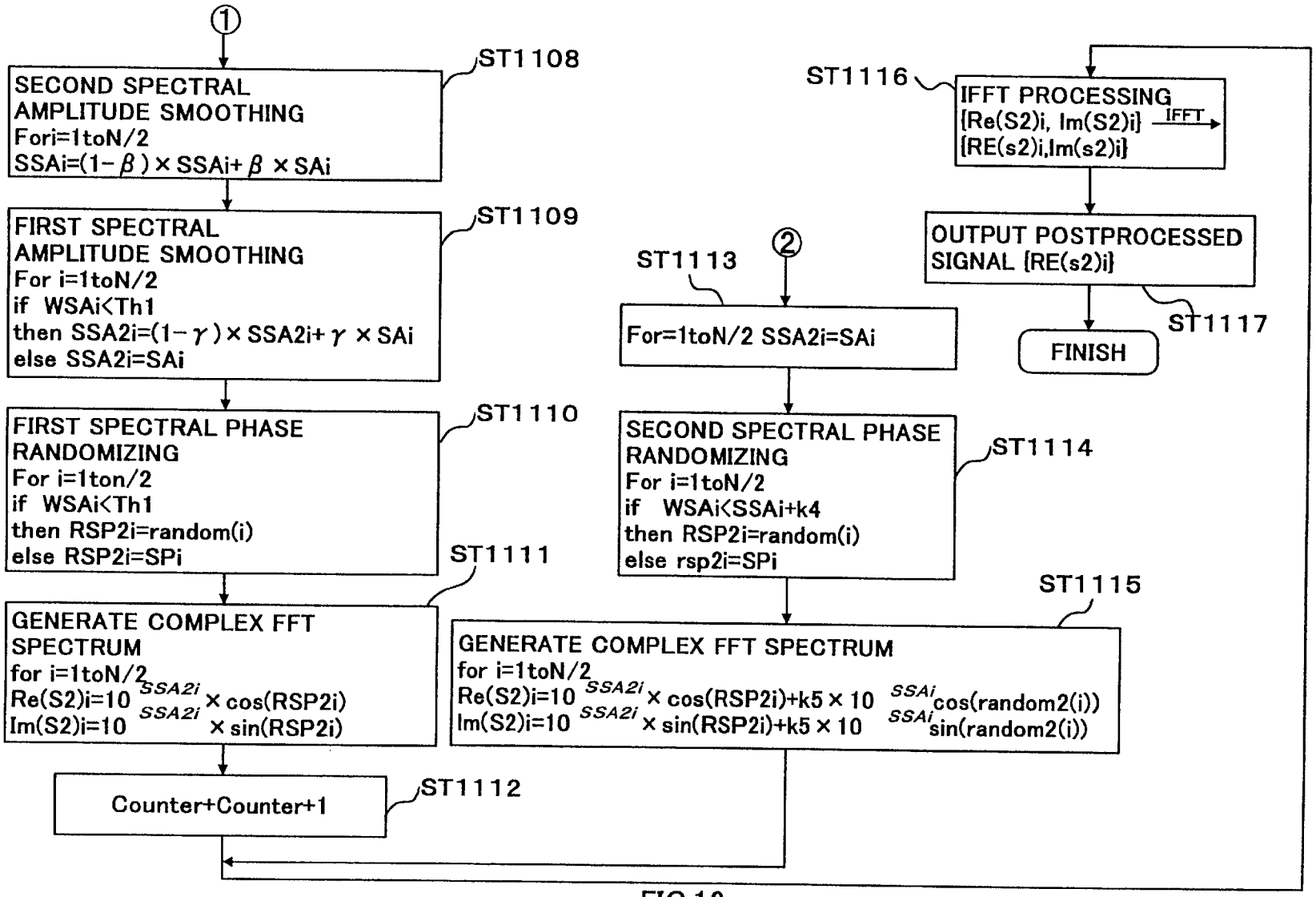
FIG. 12 is a flowchart for the latter part of the multimode postprocessing in the fifth embodiment of the present invention.

The postprocessing method previously described is next explained using FIGS.11 and 12. FIG. 11 is a flowchart illustrating specific processing of the postprocessing method in this embodiment.

First, in ST1101, FFT logarithmic spectral amplitude (WSAi) of a perceptual weighted input signal (decoded speech signal) is calculated.

Next, in ST1102, the first threshold Th1 is calculated. Th1 is obtained by adding a constant k1 to the average of WSAi. The value of k1 is determined empirically, and, for example, about 0.4 in the common logarithmic region. Assuming that the number of FFT points is N, and that the FFT spectral amplitude is WSAi (i=1,2, . . . , N), the average of WSAi is obtained by calculating the average value of an N/2 number of WSAi because WSAi is symmetry with respect to the boundary of i=N/2 and i=N/2+1.

Next, in ST1103, FFT logarithmic spectral amplitude (SAi) and FFT spectral phase (SPi) of an input signal (decoded speech signal) that is not perceptual weighted is calculated.

Next, in ST1104, the spectral difference (Diff) is calculated. The spectral difference is the total residual spectra each obtained by subtracting the average FFT logarithmic spectral amplitude (SSAi) in the region previously judged as the stationary noise region from the current FFT logarithmic spectral amplitude (SAi). The spectra difference Diff obtained in this step is a parameter to judge whether or not the current power is larger than the average power of the stationary noise region. When the current power is larger than the average power of the stationary noise region, the region has a signal different from a stationary noise component, and therefore the region is judged to be not the stationary noise region.

Next, in ST1105, the counter is checked. The counter is indicative of the number of times the decoded signal is judged as the stationary noise region previously. In the case where the number of the counter is more than a predetermined value, in other words, when it is judged that the decoded signal is the stationary noise region previously with some extent of stability, the processing proceeds to ST1107. In the other case, in other words, when it is little judged that the decoded signal is the stationary noise region previously, the processing proceeds to ST1106. The difference between ST1106 and ST1107 is that the spectral difference (Diff) is used or not as a judgment criterion. The spectral difference (Diff) is calculated using the average FFT logarithmic spectral amplitude (SSAi) in the region previously judged as the stationary noise region. To obtain such an average FFT logarithmic spectral amplitude (SSAi), it is necessary to use a previous stationary noise region with a sufficient time length of some extent, and therefore ST1105 is provided. When there is no previous stationary noise region with a sufficient time length, since it is considered that the average FFT logarithmic spectral amplitude (SSAi) is not averaged sufficiently, the processing is intended to proceed to ST1106 in which the spectral difference(Diff) is not used. The initial value of the counter is 0.

Next, in ST1106 or ST1107, it is judged whether or not the decoded signal is the stationary noise region. In ST1106, it is judged that the decoded signal is the stationary noise region in the case where an excitation mode that is already determined in the speech decoding apparatus is the stationary noise region mode. In ST1107, it is judged that the decoded signal is the stationary noise region in the case where an excitation mode that is already determined in the speech decoding apparatus is the stationary noise region mode, and the spectral difference (Diff) calculated in ST1104 is equal to or less than the threshold K3. In ST1106 or ST1107, the processing proceeds to ST1108 when it is judged that the decoded signal is the stationary noise region, while the processing proceeds to ST1113 when it is judged that the decoded signal is not the stationary noise region, in other words, that the decoded signal is the speech region.

When it is judged that the decoded signal is the stationary noise region, the smoothing processing is next performed in ST1108 to obtain the average FFT logarithm spectrum (SSAi) of the stationary noise region.

In the equation in ST1108, β is a constant indicative of an intensity of smoothing in the range of 0.0 to 0.1. β may be about 0.1 when the number of FFT points is 128, and a unit processing time is 10 ms (80 points in 8 kHz sampling). The smoothing processing is performed on all logarithmic spectral amplitudes (SAi, i=1, . . . , N, N is the number of FFT points).

Next, in ST1109, the smoothing processing of FFT logarithmic spectral amplitude is performed to perform smoothing on the spectral amplitude difference of the stationary noise region. The smoothing processing is the same as that in ST1108. However, the smoothing processing in ST1109 is not performed on all logarithmic spectral amplitudes (SAi), but performed on a signal component with a frequency i such that the perceptual weighted logarithmic spectral amplitude (WSAi) is equal to or less than the threshold Th1. γ in the equation in ST1109 is the same as β in ST1108, and may have the same value as β. Partially smoothed logarithmic spectral amplitude SSA2*i* is obtained in ST1109.

Next, in ST1110, the randomizing processing is performed on the FFT spectral phase. The randomizing processing is performed on a signal component with a selected frequency in the same way as in the smoothing processing in ST1109. In other words, as in ST1109, the randomizing processing is performed on the signal component with the frequency i such that the perceptual weighted logarithmic spectral amplitude (WSAi) is equal to or less than the threshold Th1. At this point, it may be possible to set Th1 at the same value as in ST1109, and also possible to set Th1 at a different value adjusted to obtain higher subjective quality. In addition, random (i) in ST1110 is a numerical value ranging from $-2\pi$ to $+2\pi$ generated randomly. To generate random (i) it may be possible to generate a random number newly every time. To save a computation amount, it may be also possible to hold pre-generated random numbers in a table to use while circulating the contents of the table for each unit processing time. When the table is used, two cases are considered that the contents of the table is used without modification, and that the contents of the table is added to the FFT spectral phase to use.

Next, in ST1111, a complex FFT spectrum is generated from the FFT logarithmic spectral amplitude and FFT spectral phase. The real part is obtained by returning the FFT logarithmic spectral amplitude SSA2*i* from the logarithmic region to the linear region, and then multiplying by a cosine of a spectral phase RSP2*i*. The imaginary part is obtained by returning the FFT logarithmic spectral amplitude SSA2*i* from the logarithmic region to the linear region, and then multiplying by a sine of the spectral phase RSP2*i*.

Next, in ST1112 t he number of the counter indicative of the region judged as the stationary noise region is incremented by 1.

On the other hand, when it is judged that the decoded signal is the speech region (not the stationary noise region) in ST1106 or ST1107, next in ST1113, the FFT logarithmic spectral amplitude SAi is copied as the smoothed logarithmic spectrum SSA2i. In other words, the smoothing processing of the logarithmic spectral amplitude is not performed.

Next, in ST1114, the randomizing processing of the FFT spectral phase is performed. The randomizing processing is performed on a signal component with a selected frequency as in ST1110. However, the threshold for use in selecting the frequency is not Th1, but a value obtained by adding a constant k4 to SSAi previously obtained in ST1108. This threshold equals to the second threshold Th2*i* in FIG. 6. In other words, the randomizing of the spectral phase is performed on a signal component with a frequency such that the spectral amplitude is smaller than the average spectral amplitude of the stationary noise region.

Next, in ST1115, a complex FFT spectrum is generated from the FFT logarithmic spectral amplitude and FFT spectral phase. The real part is obtained by adding the value obtained by returning the FFT logarithmic spectral amplitude SSA2*i* from the logarithmic region to the linear region, and then multiplying by the cosine of the spectral phase RSP2*i*, and a value obtained by multiplying a value obtained by returning the FFT logarithmic spectral amplitude SSAi from the logarithmic region to the linear region by a cosine of a spectral phase random2(*i*), and further multiplying the resultant by the constant k5. The imaginary part is obtained by adding the value obtained by returning the FFT logarithmic spectral amplitude SSA2*i* from the logarithmic region to the linear region, and then multiplying by the sine of the spectral phase RSP2*i*, and a value obtained by multiplying a value obtained by returning the FFT logarithmic spectral amplitude SSA*i* from the logarithmic region to the linear region by a sine of the spectral phase random2(*i*), and further multiplying the resultant by the constant k5. The constant k5 is in the range of 0.0 to 1.0, and specifically set at about 0.25. In addition, k5 may be an adaptively controlled variable. It is possible to improve the subjective qualities of the background stationary noise in the speech region by multiplexing the average stationary noise multiplied by k. The random2(*i*) is the same random number as random(*i*).

Next, in ST1116, IFFT is performed on complex FFT spectrum (Re(S2)*i*. Im(S2)*i*) generated in ST1111 or ST1115 to obtain a complex (Re(s2)*i*, Im(s2)*i*).

Finally, in ST1117, the real part Re(s2)*i* of the complex obtained by the IFFT is output.

According to the multimode speech coding apparatus of the present invention, since the coding mode of the second coding section is determined using the coded result in the first coding section, it is possible to provide the second coding section with the multimode without adding any new information indicative of a mode, and thereby to improve the coding performance.

In this constitution, the mode switching section switches the mode of the second coding section that encodes the excitation vector using the quantized parameter indicative of speech spectral characteristic, whereby in the speech coding apparatus that encodes parameters indicative of spectral characteristics and parameters indicative of the excitation vector independently of each other, it is possible to provide the coding of the excitation vector with the multimode without increasing new transmission information, and therefore to improve the coding performance.

In this case, since it is possible to detect the stationary noise segment using dynamic characteristics for the mode selection, the excitation vector coding provided with the multimode improves the coding performance for the stationary noise segment.

Further, in this case, the mode switching section switches the mode of the processing section that encodes the excitation vector using quantized LSP parameters, and therefore it is possible to apply the present invention simply to a CELP system that uses the LSP parameters as parameters indicative of spectral characteristics. Furthermore, since the LSP parameters that are parameters in a frequency region are used, it is possible to perform the judgment of the stationarity of the spectrum, and therefore to improve the coding performance for stationary noises.

Moreover, in this case, the mode switching section judges the stationarity of the quantized LSP using the previous and current quantized LSP parameters, judges the voiced characteristics using the current quantized LSP, and based on the judgment results, performs the mode selection of the processing section that encodes the excitation vector, whereby it is possible to perform the coding of the excitation vector while switching between the stationary noise segment, unvoiced speech segment and voiced speech segment, and therefore to improve the coding performance by preparing the coding mode of the excitation vector corresponding to each segment.

In the speech decoding apparatus of the present invention, since it is possible to detect the case that the power of a decoded signal is suddenly increased, it is possible to cope with the case that a detection error is caused by the above-mentioned processing section that detects the speech region.

Further, in the speech decoding apparatus of the present invention, since it is possible to detect the stationary noise segment using dynamic characteristics, the excitation vector coding provided with the multimode the excitation vector coding provided with the multimode improves the coding performance for the stationary noise segment.

As described above, according to the present invention, since the mode selection of speech coding and/or decoding postprocessing is performed using the static and dynamic characteristics in the quantized data of parameters indicative of spectral characteristics, it is possible t provide the speech coding with the multimode without newly transmitting the mode information. In particular, since it is possible to perform the judgment of the speech region/non-speech region in addition to the judgment of the voiced region/unvoiced region, it is possible to provide the speech coding apparatus and speech decoding apparatus enabling the increased improvement of the coding performance by the multimode.

This application is based on the Japanese Patent Applications No.HEI10-236147 filed on Aug. 21, 1988, and No.HEI10-266883 filed on Sep. 21, 1988, entire content of which is expressly incorporated by reference herein.

Industrial Applicability

The present invention is effectively applicable to a communication terminal apparatus and base station apparatus in a digital radio communication system.

What is claimed is:

1. A multimode speech coding apparatus comprising:

first coding means for coding an LSP parameter indicative of vocal tract information contained in a speech signal;

second coding means for coding at least one type of parameter indicative of vocal tract information contained in the speech signal with a plurality of modes;

dynamic characteristic extracting means for extracting a dynamic characteristic of a quantized LSP parameter coded in said first coding means, said quantized LSP parameter being indicative of a spectral characteristic of a speech;

mode switching means for switching a coding mode of said second coding means based on said dynamic characteristic; and synthesis means for synthesizing an input speech signal incorporating and using a plurality of types of parameter information coded in said first coding means and said second coding means, wherein said second coding means comprises coding means for coding an excitation vector with a plurality of coding modes, said mode switching means switches said coding mode of said second coding means using said quantized LSP parameter indicative of a spectral characteristic of a speech, whereby information concerning said coding mode is not explicitly included in the synthesized input speech signal.

2. The multimode speech coding apparatus according to claim 1, wherein said mode switching means switches the coding mode of said second coding means using a static characteristic and a dynamic characteristic of the quantized LSP parameter.

3. The multimode speech coding apparatus according to claim 1, wherein said mode switching means comprises means for judging stationarity of the quantized LSP parameter using a previous quantized LSP parameter and a current quantized LSP parameter, and means for judging a voiced characteristic using the current quantized LSP parameter, and based on judged results, switches the coding mode of said second coding means.

4. The multimode speech coding apparatus according to claim 1, wherein said dynamic characteristic extracting means comprises:

means for calculating a difference between frames of said quantized LSP parameter;

means for calculating an average quantized LSP parameter in a frame in which said quantized LSP parameter is stationary; and means for calculating a distance between said average quantized LSP parameter and a current quantized LSP parameter.

5. A multimode speech decoding apparatus comprising:

first decoding means for decoding a quantized LSP parameter indicative of vocal tract information contained in a speech signal;

second decoding means for decoding at least one type of parameter indicative of vocal tract information contained in the speech signal with a plurality of decoding modes;

mode switching means for switching a decoding mode of said second decoding means based on a dynamic characteristic of the LSP parameter decoded in said first decoding means;

synthesis means for decoding the speech signal using a plurality of types of parameter information decoded in said first decoding means and said second decoding means; and postprocessing means for performing postprocessing on the decoded speech signal based on the decoding mode, wherein said second decoding means comprises decoding means for decoding an excitation vector with a plurality of decoding modes, and said mode switching means switches the decoding mode of said second decoding means using the quantized LSP parameter indicative of a spectral characteristic of a speech included in the speech signal.

6. The multimode speech decoding apparatus according to claim 5, wherein said mode switching means switches the decoding mode of said second decoding means using a static characteristic and a dynamic characteristic of the quantized LSP parameter indicative of the spectral characteristic of the speech.

7. The multimode speech decoding apparatus according to claim 6, wherein said mode switching means comprises means for judging stationarity of the quantized LSP parameter using a previous quantized LSP parameter and a current quantized LSP parameter, and means for judging a voiced characteristic using the current quantized LSP parameter, and based on judged results, switches the decoding mode of said second decoding means.

8. The multimode speech decoding apparatus according to claim 7 wherein said apparatus switches postprocessing for a decoded signal based on said results.

9. The multimode speech decoding apparatus according to claim 5, wherein said postprocessing means comprises:

judging means for judging whether or not a region is a speech interval using the decoded LSP parameter:

FFT processing means for performing Fast Fourier Transform processing on a signal;

spectral phase randomizing means for randomizing a spectral phase obtained by said Fast Fourier Transform processing corresponding to a judged result by said judging means;

spectral amplitude smoothing means for smoothing a spectral amplitude obtained by said Fast Fourier Transform processing corresponding to the judged result; and IFFT processing means for performing Inverse Fast Fourier Transform processing on the spectral phase randomized by said spectral phase randomizing means and the spectral amplitude smoothed by said spectral amplitude smoothing means.

10. A quantized-LSP-parameter dynamic characteristic extractor comprising:

means for calculating an evolution of a quantized LSP parameter between frames;

means for calculating an average quantized LSP parameter in a frame in which the quantized LSP parameter is stationary; and means for calculating an evolution between said average quantized LSP parameter and a current quantized LSP parameter.

11. A quantized-LSP-parameter static characteristic extractor comprising:

means for calculating linear prediction residual power using a quantized LSP parameter; and means for calculating a region between neighboring orders of the quantized LSP parameter.

12. A multimode postprocessing apparatus comprising:

judgment means for judging whether or not a region is a speech region using a decoded LSP parameter;

FFT processing means for performing fast Fourier transform processing on a signal;

spectral phase randomizing means for randomizing a spectral phase obtained by said fast Fourier transform processing corresponding to a result judged by said judgment means;

spectral amplitude smoothing means for performing smoothing on a spectral amplitude obtained by said fast Fourier transform processing corresponding to said result; and IFFT processing means for performing inverse fast Fourier transform on the spectral phase randomized by said spectral phase randomizing means and the spectral amplitude smoothed by said spectral amplitude smoothing means.

13. The multimode postprocessing apparatus according to claim 12, wherein said device determines a frequency of the spectral phase to be randomized using an average spectral amplitude of a previous unvoiced region in a speech region, and determines a frequency of the spectral phase to be randomized and the spectral amplitude to be smoothed using an average spectral amplitude with all frequencies in a perceptual weighted domain in an unvoiced region.

14. The multimode postprocessing apparatus according to claim 12, wherein said device multiplexes in a speech region a noise generated using average spectral amplitude in a previous non-speech region.

15. A speech signal transmission apparatus having a speech input apparatus that converts a speech signal into an electric signal, an A/D converter that converts a signal output from the speech input apparatus into a digital signal, a multimode speech coding apparatus that codes the digital signal output from the A/D converter, an RF modulator that performs modulation processing on coded information output from the multimode speech coding apparatus, and a transmission antenna that converts a signal output from the RF modulator into radio signal to transmit, said multimode speech coding apparatus comprising:

first coding means for coding an LSP parameter indicative of vocal tract information contained in a speech signal;

second coding means for coding at least one type of parameter indicative of vocal tract information with a plurality of modes;

dynamic characteristic extracting means for extracting a dynamic characteristic of a quantized LSP parameter coded in said first coding means;

mode switching means for switching a coding mode of said second coding means based on said dynamic characteristic; and synthesis means for synthesizing an input speech signal using a plurality of types of parameter information coded in said first coding means and said second coding means.

16. The speech signal transmission apparatus according to claim 15, wherein said dynamic characteristic extracting means comprises:

means for calculating a difference between frames of the quantized LSP parameter;

means for calculating an average quantized LSP parameter in a frame in which the quantized LSP parameter is stationary; and means for calculating a distance between the average quantized LSP parameter and a current quantized LSP parameter.

17. A speech signal reception apparatus having a reception antenna that receives a radio signal, an RF demodulator that performs demodulation processing on a signal received at the reception antenna, a multimode decoding apparatus that decodes information obtained by the RF demodulator, a D/A converter that converts a digital speech signal decoded in the multimode decoding apparatus into an analog signal, and a speech output apparatus that converts an electric signal output from the D/A converter into a speech signal, said multimode decoding apparatus comprising:

first decoding means for decoding a quantized LSP parameter indicative of vocal tract information contained in a speech signal;

second decoding means for decoding at least one type of parameter indicative of vocal tract information contained in the speech signal with a plurality of decoding modes;

mode switching means for switching a decoding mode of said second decoding means based on a dynamic characteristic of the LSP parameter decoded in said first decoding means;

synthesis means for decoding the speech signal using a plurality of types of parameter information decoded in said first decoding means and said second decoding means; and postprocessing means for performing postprocessing on the decoded speech signal based on the decoding mode.

18. A computer readable recording medium with a computer executable program recorded therein, the program comprising the procedures of:

extracting a dynamic characteristic of a quantized LSP parameter using a previous quantized LSP parameter and a current quantized LSP parameter;

judging a voiced characteristic using the dynamic characteristic of the current quantized LSP parameter; and switching a mode of a procedure for coding an excitation vector, based on the judged result.

19. A computer readable recording medium with a computer executable program recorded therein, the program comprising the procedures of:

extracting a dynamic characteristic of a quantized LSP parameter using a previous quantized LSP parameter and a current quantized LSP parameter;

judging a voiced characteristic using the current quantized LSP parameter;

switching a mode of a procedure for decoding an excitation vector, based on the judged result; and switching a procedure of performing postprocessing on a decoded signal, based on the judged result.

20. A multimode speech coding method for performing mode switching of a mode for coding an excitation vector, using a static characteristic and a dynamic characteristic of a quantized parameter indicative of a spectral characteristic of a speech.

21. A multimode speech decoding method for performing mode switching of a mode for decoding an excitation vector, using a static characteristic and a dynamic characteristic of a quantized parameter indicative of a spectral characteristic of a speech.

22. The multimode speech decoding method according to claim 21, said method comprising the steps of:

performing postprocessing on a decoded signal; and switching the step of performing postprocessing, based on mode information.

23. A quantized-LSP-parameter dynamic characteristic extracting method comprising the steps of:

calculating an evolution of a quantized LSP parameter between frames;

calculating an average quantized LSP parameter in a frame in which the quantized LSP parameter is stationary; and calculating an evolution between said average quantized LSP parameter and a current quantized LSP parameters.

24. The speech signal reception apparatus according to claim 23, wherein said postprocessing means comprises:

judging means for judging whether or not a region is a speech interval using the decoded LSP parameter;

FFT processing means for performing Fast Fourier Transform processing on a signal;

spectral phase randomizing means for randomizing a spectral phase obtained by said Fast Fourier Transform processing corresponding to a judged result by said judging means;

spectral amplitude smoothing means for smoothing a spectral amplitude obtained by said Fast Fourier Transform processing corresponding to the judged result; and IFFT processing means for performing Inverse Fast Fourier Transform processing on the spectral phase randomized by said spectral phase randomizing means and the spectral amplitude smoothed by said spectral amplitude smoothing means.

25. A quantized-LSP-parameter static characteristic extracting method comprising the steps:

calculating linear prediction residual power using a quantized LSP parameter; and calculating a region between neighboring orders of the quantized LSP parameter.

26. A multimode postprocessing method comprising:

the judgment step of judging whether or not a region is a speech region using a decoded LSP parameter;

the FFT processing step of performing fast Fourier transform processing on a signal;

the spectral phase randomizing step of randomizing a spectral phase obtained by said fast Fourier transform processing corresponding to a result determined by said judgment step;

the spectral amplitude smoothing step of performing smoothing on a spectral amplitude obtained by said fast Fourier transform processing corresponding to said result; and the IFFT processing step of performing inverse fast Fourier transform on the spectral phase randomized by said spectral phase randomizing step and the spectral amplitude smoothed by said spectral amplitude smoothing step.

27. A multimode speech coding apparatus comprising:

first coding means for coding vocal tract information contained in a speech signal; and second coding means for coding excitation information contained in the speech signal, said second coding means having a plurality of coding modes;

wherein each of said plurality of coding modes is determined using a variation in the information coded in said first coding means, each of said plurality of coding modes comprises a non-speech interval mode and a speech interval mode, each said speech interval mode comprises a voiced interval mode and an unvoiced interval mode and coding is performed separately to a voiced region and an unvoiced region separated from the speech interval.

28. The multimode speech coding apparatus according to claim 27, wherein said first coding means codes a spectral characteristic parameter of the speech signal.

* * * * *